US011598125B2

(12) United States Patent
Raz

(10) Patent No.: US 11,598,125 B2
(45) **Date of Patent: *Mar. 7, 2023**

(54) LATCH ARRANGEMENT

(71) Applicant: Dan Raz LTD., Tirat Carmel (IL)

(72) Inventor: Amir Raz, Haifa (IL)

(73) Assignee: DAN RAZ LTD., Tirat Carmel (IL)

( * ) Notice: Subject to any disclaimer, the term of this patent is extended or adjusted under 35 U.S.C. 154(b) by 398 days.

This patent is subject to a terminal disclaimer.

(21) Appl. No.: 16/643,893

(22) PCT Filed: Sep. 3, 2017

(86) PCT No.: PCT/IL2017/050984

§ 371 (c)(1),
(2) Date: Mar. 3, 2020

(87) PCT Pub. No.: WO2019/043678

PCT Pub. Date: Mar. 7, 2019

(65) Prior Publication Data

US 2020/0263452 A1 Aug. 20, 2020

(51) Int. Cl.
*E05B 63/24* (2006.01)
*E05B 15/10* (2006.01)
(Continued)

(52) U.S. Cl.
CPC ..... *E05B 63/248* (2013.01); *E05B 15/102* (2013.01); *E05B 47/0001* (2013.01);
(Continued)

(58) Field of Classification Search
CPC .... E05B 63/24; E05B 63/248; E05B 63/0052; E05B 15/10; E05B 15/102; E05B 65/06;
(Continued)

(56) References Cited

U.S. PATENT DOCUMENTS 313,742 A 3/1885 Kintner
435,658 A 9/1890 Brennaman
(Continued)

FOREIGN PATENT DOCUMENTS

AU 627346 B2 8/1992
AU 641561 B2 9/1993
(Continued)

*Primary Examiner* — Alyson M Merlino
(74) *Attorney, Agent, or Firm* — Mark M. Friedman

(57) ABSTRACT

A latch arrangement for fastening a panel of a door or a window to a frame element is provided. The latch arrangement includes a locking element mounted on the frame element and displaceable between a locked position in which the locking element can be engaged with the panel locking thereby the panel to the frame element, and an unlocked position in which the locking element is disengaged from the panel unlocking thereby the panel from the frame element. An actuating mechanism, optionally including a manually operable handle, is mounted on the panel and configured to selectively engage the locking element and to displace the locking element to the unlocked position. Where a stop latch provides deadlock functionality, the panel-mounted actuating mechanism preferably sequentially releases the stop latch and then displaces the locking element.

12 Claims, 29 Drawing Sheets

(51) Int. Cl.

| | |
|---|---|
| ***E05B 65/10*** | (2006.01) |
| ***E05C 19/00*** | (2006.01) |
| ***E05C 3/16*** | (2006.01) |
| ***E05B 47/00*** | (2006.01) |
| *E05B 47/02* | (2006.01) |

(52) U.S. Cl.
CPC ..... *E05B 47/0012* (2013.01); *E05B 65/1046* (2013.01); *E05C 19/002* (2013.01); *E05B 47/023* (2013.01); *E05C 3/16* (2013.01)

(58) Field of Classification Search
CPC .. E05B 65/0835; E05B 17/20; E05B 17/2007; E05B 17/203; E05B 17/2034; E05B 17/2049; E05B 17/2053; E05C 19/001; E05C 19/002; E05C 3/00; E05C 3/004; E05C 3/008; E05C 3/006; E05C 3/12; E05C 3/16; E05C 3/162; E05C 3/22; Y10T 292/1075; Y10T 292/1078; Y10T 292/108; Y10T 292/192; Y10T 292/54; Y10T 292/564; Y10S 292/71
See application file for complete search history.

(56) References Cited

U.S. PATENT DOCUMENTS 868,036 A 10/1907 Tong
1,185,422 A 5/1916 Mammelli
1,231,069 A * 6/1917 Schaffert ..... E06B 3/12 296/145
1,609,342 A 12/1926 Winters
1,932,733 A * 10/1933 Hendrick ..... E05B 63/24 70/486
1,973,461 A 9/1934 Barringer
2,029,901 A 2/1936 Voight
2,043,787 A * 6/1936 Wild ..... E05B 63/248 70/145
2,108,965 A 2/1938 Gray
2,430,351 A 11/1947 Lidow
2,561,201 A 7/1951 Hogg
2,572,717 A 10/1951 Gersten
2,579,875 A 12/1951 Stanko
2,779,618 A 1/1957 Jewell
2,812,204 A 11/1957 Squire
2,834,066 A 5/1958 Lybarger
2,978,757 A 4/1961 Ammerman
3,002,592 A 10/1961 Quinn
3,019,493 A 2/1962 Walenga
3,065,986 A 11/1962 Barker
3,159,093 A 12/1964 Rosenfeld
3,172,168 A 3/1965 Suska
3,222,098 A 12/1965 Hausfeld
3,577,252 A 5/1971 Brugger
3,596,954 A 8/1971 Hull et al.
3,634,962 A 1/1972 Peterson
3,841,516 A 10/1974 Marz
3,872,696 A 3/1975 Geringer
3,877,262 A 4/1975 Williams
3,877,282 A 4/1975 Pogonowski
3,924,884 A 12/1975 Christie
3,959,927 A 6/1976 Good
3,973,794 A 8/1976 Green
4,004,629 A 1/1977 Kelly
4,010,239 A 3/1977 Dor
4,045,065 A 8/1977 Johnson
4,056,276 A 11/1977 Jarvis
4,062,576 A 12/1977 Jennings et al.
4,099,753 A 7/1978 Gwozdz
4,106,239 A 8/1978 Bancroft et al.
4,110,857 A 9/1978 Gwozdz
4,110,867 A 9/1978 Gwozdz
4,126,965 A 11/1978 Tivadar
4,133,142 A 1/1979 Dzus, Jr.
4,180,287 A 12/1979 Youngblood et al.
4,203,255 A 5/1980 Macdonald et al.
4,216,956 A 8/1980 Ichinomiya et al.
4,216,986 A 8/1980 McNinch et al.
4,230,351 A 10/1980 Bisbing
4,300,795 A 11/1981 Jennings
4,367,610 A 1/1983 Goode
4,428,153 A 1/1984 Klinger et al.
4,441,277 A 4/1984 Naylor
4,534,587 A 8/1985 Fleming
4,610,472 A 9/1986 Bllingsley
4,643,005 A 2/1987 Logas
4,765,662 A * 8/1988 Suska ..... E05B 65/06 292/254
4,824,154 A 4/1989 Simpson
4,831,779 A 5/1989 Kehrli et al.
4,856,830 A 8/1989 Chateau
5,137,327 A 8/1992 Edmonds et al.
5,172,520 A 12/1992 Hostetler
5,188,404 A 2/1993 Orendorff
5,224,297 A 7/1993 Watkins
5,319,882 A 6/1994 Biebuyck
5,326,141 A 7/1994 Gorman
5,349,782 A 9/1994 Yulkowski
5,361,539 A 11/1994 Widener
5,403,047 A 4/1995 Walls
5,409,272 A 4/1995 McCormack
5,465,460 A 11/1995 Cantone
5,465,480 A 11/1995 Karl et al.
5,570,915 A 11/1996 Asadurian
5,615,919 A 4/1997 Ivey
5,660,021 A * 8/1997 Wolgamot ..... B32B 7/022 52/783.17
5,901,501 A 5/1999 Fountaine
5,927,773 A 7/1999 Larsen et al.
5,931,415 A 8/1999 Lingard et al.
6,185,871 B1 2/2001 Wang
6,286,274 B1 9/2001 McKann
6,409,234 B1 6/2002 Larsen et al.
6,534,000 B1 3/2003 Moshe
6,564,428 B2 5/2003 Richard et al.
7,000,550 B1 2/2006 Mandall
7,182,374 B2 2/2007 Figge et al.
7,578,531 B1 8/2009 Leontaridis
7,707,776 B2 5/2010 Weissofner et al.
8,038,184 B2 10/2011 Grigis
8,146,393 B2 4/2012 Katagiri et al.
8,424,931 B2 4/2013 Chang
8,468,746 B2 6/2013 Salerno et al.
8,627,606 B2 1/2014 Salerno et al.
8,707,625 B2 4/2014 Raz et al.
8,813,427 B2 8/2014 Meeks
8,925,249 B2 1/2015 Speyer et al.
9,145,719 B2 9/2015 Hartford
9,598,894 B2 3/2017 Raz
9,670,691 B2 6/2017 Mansueto et al.
9,702,168 B2 7/2017 Jadallah et al.
9,970,214 B2 5/2018 Raz
10,138,654 B2 11/2018 Raz
10,221,595 B2 3/2019 Ward et al.
10,480,213 B2 11/2019 Raz
2002/0046501 A1 4/2002 Webb
2002/0046601 A1 4/2002 Yasuda et al.
2002/0095885 A1 7/2002 Sampson
2002/0145292 A1 10/2002 Furner
2002/0163208 A1 11/2002 Quigley et al.
2004/0222649 A1 11/2004 Ito et al.
2005/0001435 A1 1/2005 Parker
2005/0001436 A1 1/2005 Ramsauer
2006/0021400 A1 2/2006 Jackson
2007/0113478 A1 5/2007 Chu et al.
2007/0290456 A1 * 12/2007 Speyer ..... E05C 19/002 277/628
2008/0054123 A1 3/2008 French
2008/0129054 A1 6/2008 Tremble et al.
2009/0178344 A1 7/2009 Salerno et al.
2009/0289065 A1 11/2009 Sampson
2012/0204503 A1 8/2012 Helton
2014/0190098 A1 7/2014 Raz et al.
2014/0259946 A1 9/2014 Mansueto et al.

(56) References Cited

U.S. PATENT DOCUMENTS

| | | | |
|---|---|---|---|
| 2015/0123411 | A1 | 5/2015 | Woo |
| 2016/0001643 | A1 | 1/2016 | Ichikawa |
| 2016/0032627 | A1 | 2/2016 | Yoshino et al. |
| 2016/0075275 | A1 | 3/2016 | Salter et al. |
| 2016/0076275 | A1 | 3/2016 | Uemura et al. |
| 2016/0076280 | A1 | 3/2016 | Rudraraju et al. |
| 2016/0083976 | A1 | 3/2016 | Rickenbaugh et al. |
| 2017/0015676 | A1 | 1/2017 | Stensrud et al. |
| 2017/0204621 | A1 | 7/2017 | Procton et al. |
| 2017/0254119 | A1 | 9/2017 | Raz |
| 2017/0254125 | A1 | 9/2017 | Raz |
| 2018/0209175 | A1 | 7/2018 | Raz |
| 2018/0252025 | A1 | 9/2018 | Raz |
| 2018/0266153 | A1 | 9/2018 | March |
| 2019/0071895 | A1 | 3/2019 | Raz |

FOREIGN PATENT DOCUMENTS

| | | | |
|---|---|---|---|
| CA | 1029063 | A | 4/1978 |
| CN | 10923197 | | 4/2018 |
| CN | 108699864 | A | 10/2018 |
| DE | 929592 | C | 6/1955 |
| DE | 2628036 | A1 | 1/1977 |
| DE | 2652562 | A1 | 6/1977 |
| DE | 2852670 | A1 | 6/1980 |
| DE | 3447796 | A1 | 7/1986 |
| DE | 8438238 | U1 | 12/1987 |
| DE | 8900012 | U1 | 3/1989 |
| DE | 29517077 | U1 | 2/1997 |
| DE | 19745180 | A1 | 4/1999 |
| DE | 19944050 | A1 | 3/2001 |
| DE | 10117173 | A1 | 10/2002 |
| DE | 10322798 | A1 | 12/2004 |
| DE | 102004054981 | A1 | 5/2006 |
| DE | 10329560 | B4 | 6/2012 |
| EP | 0067075 | A1 | 12/1982 |
| EP | 0094461 | A1 | 11/1983 |
| EP | 0094461 | A1 | 12/1986 |
| EP | 0270437 | A1 | 6/1988 |
| EP | 0811738 | A1 | 12/1997 |
| EP | 1422368 | A1 | 5/2004 |
| EP | 1574657 | A2 | 9/2005 |
| EP | 1775403 | A2 | 4/2007 |
| EP | 1832508 | B1 | 1/2009 |
| EP | 3341542 | A1 | 7/2018 |
| EP | 3347557 | A1 | 7/2018 |
| EP | 2726688 | B1 | 1/2021 |
| FR | 469276 | A | 7/1914 |
| FR | 2631068 | A1 | 11/1989 |
| FR | 2844822 | A1 | 3/2004 |
| FR | 2891295 | A1 | 3/2007 |
| GB | 1399058 | A | 6/1975 |
| GB | 2154639 | B | 6/1987 |
| GB | 2195958 | A | 4/1988 |
| GB | 2233701 | A | 1/1991 |
| GB | 2250772 | A | 6/1992 |
| GB | 2521932 | A | 7/2015 |
| WO | 201300188 | A1 | 1/2013 |
| WO | 2013001488 | A1 | 1/2013 |
| WO | 2013018496 | A1 | 2/2013 |
| WO | 2017033177 | A1 | 3/2017 |
| WO | 2017042799 | A1 | 3/2017 |
| WO | 2017090020 | A1 | 6/2017 |
| WO | 2017149544 | A1 | 9/2017 |
| WO | 2017149545 | A1 | 9/2017 |

* cited by examiner

LATCH ARRANGEMENT

FIELD OF INVENTION

The presently disclosed subject matter relates to a latch arrangement, in general and in particular to a latch arrangement for fastening a panel of a door or a window to a frame element where an actuating mechanism mounted on the panel operates a locking mechanism in the frame.

BACKGROUND

A latch arrangement for fastening a panel of a door or a window to a frame element is an arrangement which includes a locking element displaceable with respect to the panel between a locked position in which the locking element is engaged with the frame element and the panel precluding thereby the displacement of the panel away from the frame element. The locking element can be mounted on the frame element and displaceable towards and away from the panel so as to lock the panel to the frame element. Alternatively, the locking element can be mounted on the panel and can be displaceable towards and away from the frame element so as to lock the panel to the frame element.

SUMMARY OF INVENTION

There is provided in accordance with an aspect of the presently disclosed subject matter a latch arrangement for locking a panel of a door or a window to a frame element so as to extend across at least part of an opening in the frame in a plane of closure, the latch arrangement comprising: a locking element mounted on the frame element and displaceable through an unlocking motion between a locked position in which the locking element is engaged with the panel thereby locking the panel to the frame element, and an unlocked position in which the locking element is disengaged from the panel thereby unlocking the panel from the frame element, the unlocking motion including a component of rotational motion and/or a component of displacement non-parallel to the plane of closure; and an actuating mechanism mounted on the panel and configured to selectively engage the locking element and to displace the locking element out of engagement with the panel to the unlocked position.

According to a further feature of an embodiment of the present invention, the actuating mechanism comprises a handle displaceably mounted on the panel so as to be displaceable between a first positon in which the actuating mechanism urges the locking element out of engagement with the panel and a second position in which the actuating mechanism allows the locking element to engage the panel.

According to a further feature of an embodiment of the present invention, in the first position the handle is pivoted towards an opening direction of the panel.

According to a further feature of an embodiment of the present invention, the actuating mechanism includes an actuating member displaceably mounted on the panel and configured to selectively move towards the locking element whereby the locking element is displaced to the unlocked position.

According to a further feature of an embodiment of the present invention, the handle includes a portion engaging the actuating member, and wherein the handle is configured such that, when the handle is displaced to the first position, the actuating member is displaced towards the locking element whereby the locking element is displaced to the unlocked position.

According to a further feature of an embodiment of the present invention, the handle includes a panic bar displaceable towards the panel and a linkage actuated by movement of the panic bar, the linkage being configured to engage the actuating member and urge the actuating member to move towards the locking element.

According to a further feature of an embodiment of the present invention, the actuating member comprises a roller element deployed to bear on the locking element.

There is also provided according to the teachings of an embodiment of the present invention, a latch arrangement for locking a panel of a door or a window to a frame element, the latch arrangement comprising: a locking element mounted on the frame element and displaceable between a locked position in which the locking element is engaged with the panel thereby locking the panel to the frame element, and an unlocked position in which the locking element is disengaged from the panel thereby unlocking the panel from the frame element; a stop latch deployed to assume a secured position in which the stop latch mechanically obstructs motion of the locking element to prevent displacement of the locking element to the unlocked position, the stop latch being displaceable to a released position in which the locking element is free to be displaced to the unlocked position; and an actuating mechanism configured to selectively displace the stop latch to the released position and to displace the locking element to the unlocked position, wherein the actuating mechanism is mounted on the panel, According to a further feature of an embodiment of the present invention, the actuating mechanism comprises a manually displaceable handle displaceably mounted on the panel, and wherein the actuating mechanism is configured such that motion of the handle performs sequentially displacement of the stop latch to the released position following by displacement of the locking element out of engagement with the panel.

According to a further feature of an embodiment of the present invention, the stop latch is mounted on the locking element and is configured to selectively engage an abutment feature such that displacement of the locking element to the unlocked position is obstructed.

According to a further feature of an embodiment of the present invention, the stop latch is slidably mounted on the locking element and is configured to slide between the secured position and the released position in which the at least one portion is retracted away from the abutment feature such that the locking element is free to be displaced to the unlocked position.

According to a further feature of an embodiment of the present invention, the abutment feature is located on the panel.

According to a further feature of an embodiment of the present invention, the abutment feature is located on the frame element.

According to a further feature of an embodiment of the present invention, the stop latch is pivotally mounted on the locking element and is configured to pivot between the secured position and the released position.

According to a further feature of an embodiment of the present invention, the actuating mechanism includes a catch member and wherein in the secured position the stop latch is engaged with the catch member, According to a further feature of an embodiment of the present invention, the locking element in the locked position engages a pressure surface of the panel oriented at an inclination to a plane of closure of the panel against the frame such that force applied to displace the panel towards an opening direction of the panel is opposed by compressive forces applied by the pressure surface to the locking element.

There is also provided according to the teachings of an embodiment of the present invention, a latch arrangement for locking a panel of a door or a window to a frame element so as to extend across at least part of an opening in the frame in a plane of closure, the latch arrangement comprising: through an unlocking motion between a locked position in which the locking element is engaged with the panel thereby locking the panel to the frame element, and an unlocked position in which the locking element is disengaged from the panel thereby unlocking the panel from the frame element; an actuating mechanism mounted on the panel and configured to selectively engage the locking element and to displace the locking element out of engagement with the panel to the unlocked position, wherein the locking element in the locked position engages a pressure surface of the panel oriented at an inclination to the plane of closure such that force applied to displace the panel towards an opening direction of the panel is opposed by compressive forces applied by the pressure surface to the locking element.

There is also provided according to the teachings of an embodiment of the present invention, a door or a window comprising: a frame element; a panel configured to abut against a portion of the frame element; and the aforementioned latch arrangement deployed to selectively fasten the panel to the frame element, According to a further feature of an embodiment of the present invention, the panel is a sliding panel configured to slide towards and away from the frame element, between a closed state and an open state.

According to a further feature of an embodiment of the present invention, the panel is a hinged panel configured to rotate towards and away from the frame element, between a closed state and an open state.

The terms "shift" and "displace" as used herein the specification and claims refers generically to any mechanical displacement of various elements including but not limited to linear displacement, pivot movement, rotational movement and combinations thereof. The term "panel" is used to refer to the element deployed across at least part of the opening in the closed state. The panels and corresponding closures may be doors, windows or any other type of opening which is selectively closed (or partially closed) by a hinged or a sliding panel.

The phrase "mounted on" as used herein refers to a first element affixed to a second element in any disposition between the two elements including the first element disposed on the second element, inside the second element, affixed to any outer or inner surface of the second element, etc.

The phrase "defined on" as used herein refers to a feature or an element provided on a member in any manner, including integrally formed with the member, attached to the member etc.

The term "door" as used herein the specification and claims refers generically to any moving panel configured to selectively block off and allow access through an opening to a structure, such as a building or vehicle, an entrance to a confined area, or between two confined areas including hinged door, sliding door, a window of any type, as well as a hood and a trunk for covering vehicles or portions thereof, etc.

BRIEF DESCRIPTION OF THE DRAWINGS

In order to understand the disclosure and to see how it may be carried out in practice, embodiments will now be described, by way of non-limiting examples only, with reference to the accompanying drawings, in which.

DETAILED DESCRIPTION OF EMBODIMENTS

Figure 1A:
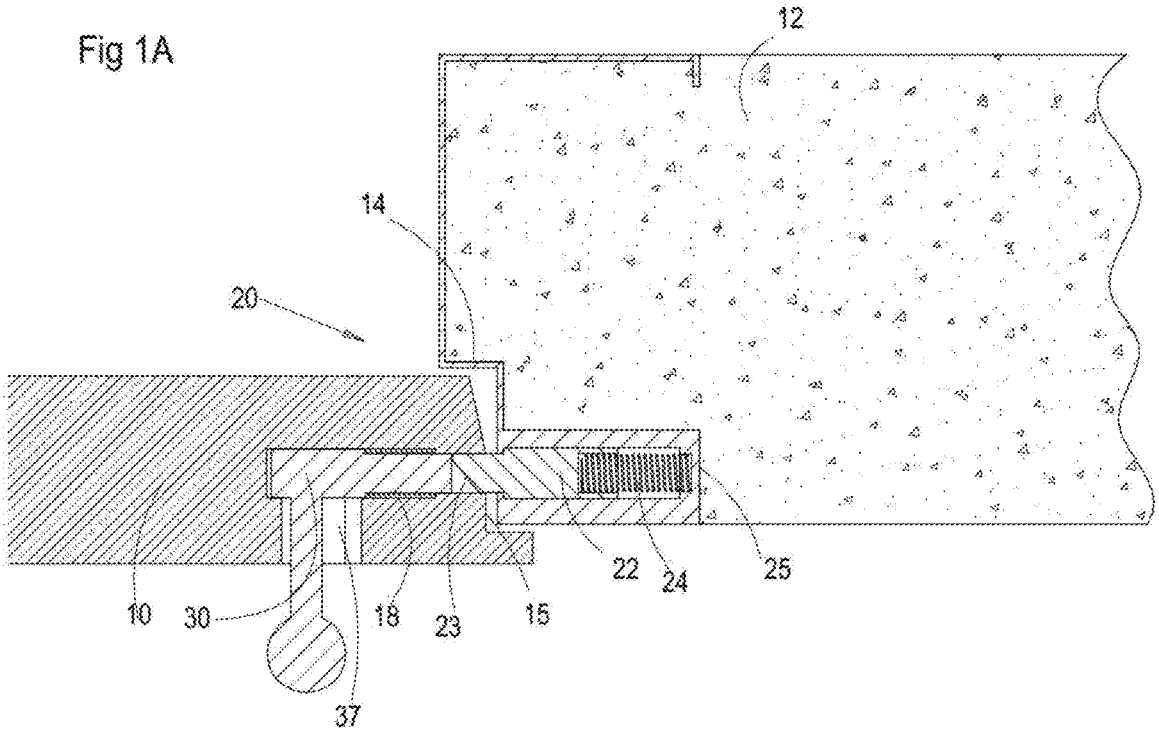
FIG. 1A is a top sectional view of a panel having latch arrangement in accordance with an example of the presently disclosed subject matter.

The invention relates to a latch arrangement for fastening a panel, such as a door or a window, to a frame element around an opening. The latch arrangements includes a locking element, such as a bolt or latch, displaceably mounted relative to the frame element for selectively engaging the panel of the door or the window. The present invention provides an actuating mechanism mounted on the door or the window panel which interacts with the locking element on the frame element. The actuating mechanism is configured to selectively displace the locking element out of engagement with the door or the window panel.

Thus opening the panel of the door or the window can be carried out by operating the actuating mechanism on the door without having to interact with a mechanism on the frame. As explained in detail with reference to the figures, the actuating mechanism may take many forms, including but not limited to, a mechanically operated handle, a key-operated lock cylinder, an electrical, hydraulic or pneumatic actuator, or any combination of the above. Each of the above options can have various shapes and can be configured in different manners, for example, with various directions of operation, and methods of interactions with the actuating mechanism, as will be exemplified below with reference to various non-limiting examples.

The present invention may be implemented in the context of a wide range of different types of locking elements. Various particularly preferred implementations illustrated in the drawings employ locking configurations in which a locking element is pivotally mounted relative to a frame element. Locking configurations of this type have been found to provide highly advantageous mechanical properties, particularly where any applied load applied to try to force open the panel is distributed along a locking element which typically extends along a significant length of the frame element (typically more than 10%, and in some cases along a majority, of the length of the frame element). An aspect of the present invention provides a solution for opening of such frame-mounted locking mechanisms via an actuating arrangement, such as a manually-operated handle mounted on the panel, thereby combining the mechanical advantages of the frame-mounted locking configuration with the intuitive operation of a panel-mounted handle. The present invention is not however limited to application to pivotal locking elements, and may equally be applied to a wide range of other types of locking elements that undergo linear or other more complex motions between their locking position and their unlocked position.

Further, according to an example, if the locking element is provided with a "stop latch" which provides a deadlock feature, the actuating mechanism is preferably configured such that motion of the handle performs sequentially release of the deadlock and then displacement of the locking element out of engagement. Various non-limiting examples of stop latch mechanisms suited to various different types of locking elements will be presented by way of example below.

A first implementation of the invention in the context of a sliding bolt will be presented herein with reference to FIGS. 1A-1D, and illustrates certain underlying principles of an aspect of the invention. FIGS. 1A to 1D show a hinged door including a door panel 10, a frame element 12, and a latch arrangement 20 for fastening the panel 10 to the frame element 12. Although the description here is directed by way of a non-limiting example to a door, it will be appreciated that the latch arrangement can be equally implemented in the context of a window or any other situation where a displaceable panel is selectively locked in place across an opening. In one set of examples illustrated herein, the latch arrangement is illustrated in the context of a hinged panel. In that case, the default deployment is typically on the strike jamb, i.e., at the side opposite the hinge. It should be noted however that the various mechanisms described may equally be deployed on a frame edge adjacent to the hinge side, or in the context of a panel which has two modes of opening in which the effective hinge can be along either of two sides of the panel. The invention may also be applied to situations where a hinge axis is located in the middle of a panel, or at any other position across a panel, or where more complex hinge arrangements define a virtual hinge outside the area of the panel, or any more complex motion.

As shown in FIGS. 1A to 1D, the door panel 10 is configured to abut, in the closed state thereof, against a shoulder portion 14 defined on an abutting portion 13 of the frame element 12. The abutting portion 13 is so disposed with respect to the door panel 10 such that it faces a frame facing portion 15 of the door panel 10, when the latter is in the closed state.

Figure 1B:
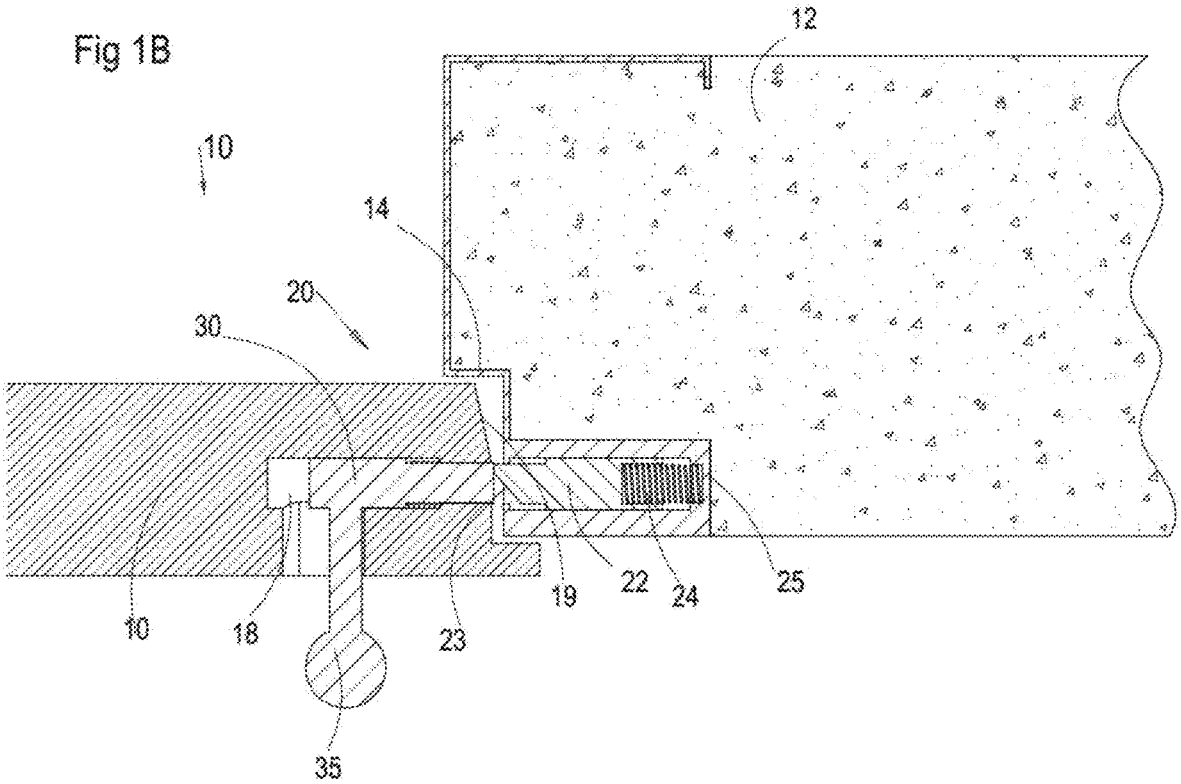
FIG. 1B is a top sectional view of the panel of FIG. 1A in an unlocked position of the latch arrangement.

The latch arrangement 20 includes a locking element, here illustrated as a retractable pin 22 slidably mounted inside a frame groove 24, which is defined on the abutting portion 13 of the frame element 12. The retractable pin 22 is configured such that a portion thereof slides in and out of the frame groove 24, between a locked position, as shown in FIG. 1A, and an unlocked positon, as shown in FIG. 1B and as explained hereinafter. According to an example, the retractable pin 22 can include a sloped tip 23 which is configured to extend out of the frame groove 24 in the locked position. The retractable pin 22, can be biased by a spring 25 mounted inside the frame groove 24 such that the retractable pin 22 is normally urged to the locked position, i.e. at least a portion of the retractable pin 22 projects outwards from the frame groove 24.

The door panel 10 includes a panel groove 18 defined on the frame facing portion 15 of the door panel 10. The panel 10 is configured such that when in the closed state thereof, the panel groove 18 is coaxially disposed with respect to the frame groove 24. This way, in the closed state of the door panel 10, the retractable pin 22 extends outwardly from the frame groove 24 and into the panel groove 18, locking thereby the panel 10 to the frame element 12, as shown in FIG. 1A.

The retractable pin 22 is thus displaceable between a locked position and an unlocked position. In the locked position, the retractable pin 22 extends out of the frame groove 24 such that when the panel 10 is in the closed state thereof, at least a portion of the retractable pin 22, i.e., the sloped tip 23, is engaged with the panel groove 18 on the panel 10, locking thereby the panel to the frame element 12. In the unlocked position, on the other hand, the retractable pin 22 is disengaged from the panel groove 18 unlocking thereby the panel 10 from the frame element 12, as shown in FIG. 1B. In the unlocked position, the retractable pin 22 can be fully or partially disposed inside the frame groove 24, such that the panel 10 can be pivoted to the open state of the door or the window.

It is appreciated that although, in the present example the retractable pin 22 is configured to engage in the locked position the panel groove 18, according to other examples the panel groove 18 can be replaced with a depression configured to allow firm engagement with the retractable pin 22.

Figure 1C:
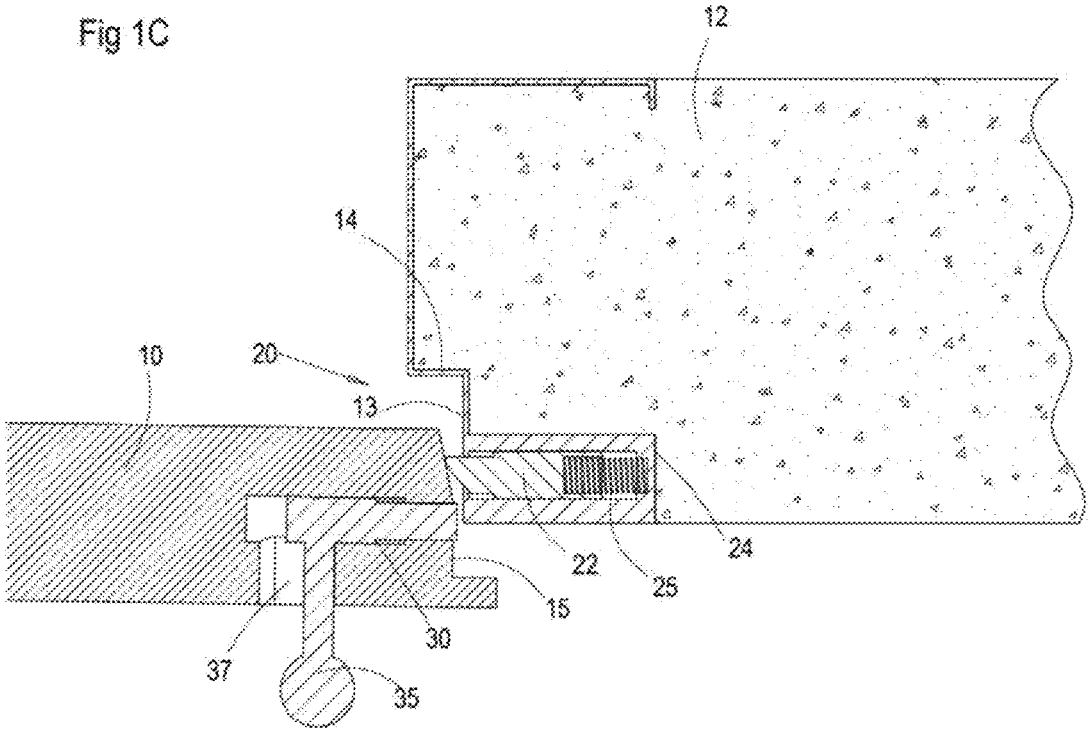
FIG. 1C is a top sectional view of the panel of FIG. 1A in an opened state thereof and in which the latch arrangement is in an unlocked position.
Figure 1D:
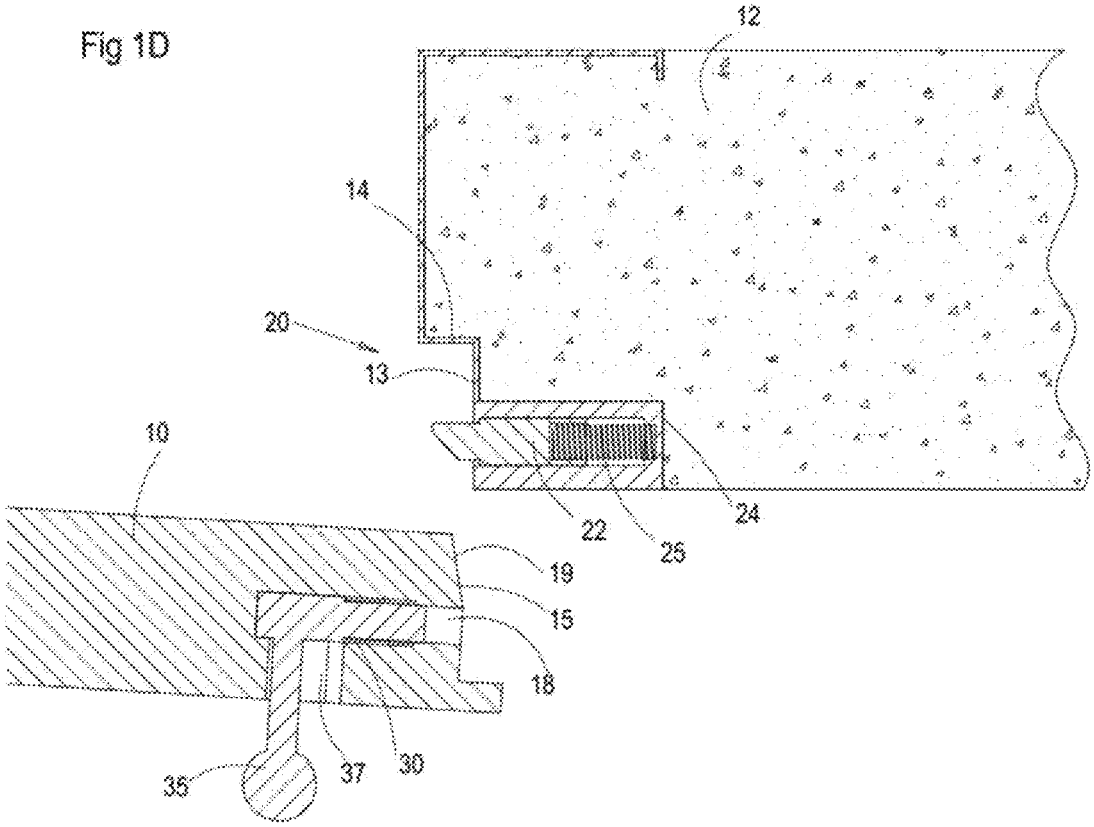
FIG. 1D is a top sectional view of the panel of FIG. 1A in an opened state thereof and in which the latch arrangement is in a locked position.

The latch arrangement 20 further includes an actuating mechanism, having an actuating member, here illustrated as an actuating pin 30 slidably disposed inside the panel groove 18. The actuating pin 30, according to an example, has a length slightly smaller than the length of the panel groove 18 such that actuating pin 30 can slide inside the panel groove 18 while the end of the panel groove 18 close to the frame facing portion 15 of the door panel 10 is unoccupied. This way, the actuating pin 30 can slide between a retracted position, as shown in FIGS. 1A and 1D, in which the actuating pin 30 is disposed on the inner end of the panel groove 18, and a forward position, as shown in FIGS. 1B and 1C, in which actuating pin 30 is disposed on the outer end of the panel groove 18, such that the end of the actuating pin 30 is substantially flush with the frame facing portion 15 of the door panel 10.

Accordingly, when the door panel 10 is in the closed state thereof, as shown in FIG. 1A, the actuating pin 30 can be slid to the retracted position, allowing the retractable pin 22 to engage the panel groove 18, and the sloped tip 23 to be inserted inside the unoccupied end of the panel groove 18, fastening thereby the door panel 10 to the frame element 12. The actuating pin 30 can however, be slid to the forwards position pushing thereby the retracted pin 22 out of the panel groove 18 to the unlocked position thereof, such that the sloped tip 23 is disengaged from the panel groove 18 and the door panel 10 is free to be displaced away from the frame element 12 and to the opened state of the door panel 10, as shown in FIG. 1B.

According to the present example a manually operable handle 35 is coupled to the actuating pin 30, and protrudes from the surface of the panel 10, allowing thereby a user to interact therewith. The handle 35 can extended through an opening 37 defined between the panel groove 18 and an outer surface of the panel 10. The opening 37 can be configured to allow sideward displacement of the handle 35. For example, the opening 37 can be wider than the width of the handle 35 such that the latter is free to be displaced in an axis parallel to the axis of the panel groove 18.

Accordingly, when the door panel 10 is in the closed state thereof the handle 35 can be moved towards the frame element 12, displacing thereby the actuating pin 30 inside the panel groove 18 to the forward position thereof. As a result the retracted pin 22 is pushed out of the panel groove 18 to the unlocked position thereof, pushing thereby the sloped tip 23 of the retractable pin 22 to disengage from the panel groove 18 such that the door panel 10 is free to be displaced away from the frame element 12 and to the opened state of the door panel 10, as shown in FIG. 1B.

The frame facing portion 15 of the panel 10 can include a sloped portion 19 configured to interact with the sloped tip 23 of the retractable pin 22. That is to say, the sloping direction of the sloped portion 19 corresponds the sloping direction of the sloped tip 23, such that when the panel is pivoted from the opened state thereof to the closed states thereof the sloped portion 19 of the frame facing portion 15 engages the sloped tip 23. This way, when the panel is pivoted towards the shoulder portion 14 the displacement thereof is not blocked by the retractable pin 22 even when the latter is in the locked position thereof, i.e. the sloped tip 23 protrudes out of the frame groove 24. Rather, the sloped portion 19 engages the sloped tip 23 of the retractable pin 22 and gradually displaces the retractable pin 22 to the retracted position thereof, such that the frame facing portion 15 can abut the shoulder portion 14.

It is appreciated that the retractable pin 22 according to other examples, can be replaced with ball bearing configured to selectively engage the panel groove 18. The ball bearing can be configured to be retracted when it is engaged by the frame facing portion 15, for example, when the panel 10 is displaced to the closed state thereof. This way, the frame facing portion 15 can be formed without the sloped portion 19.

In addition, it will be appreciated by those skilled in the art that although the present example is a hinged door panel, a similar latch arrangement can be used for a sliding door.

Turning now to FIGS. 7A-7E illustrate a further non-limiting example of a latch arrangement, generally designated 600, for locking a panel 602 of a door or a window to a frame element 604. Here too, the latch arrangement includes a locking element 606 mounted on frame element 604 that is displaceable between a locked position (FIGS. 7A-7C) in which locking element 606 is engaged with panel 602 so as to lock the panel to frame element 604, and an unlocked position (FIG. 7E) in which locking element 606 is disengaged from panel 602, thereby unlocking the panel from the frame element. As in FIGS. 1A-1D, the motion of locking element 606 here too is a sliding bolt motion in which locking element 606 slides linearly within a bolt track 608 formed in (or mounted to) frame element 604.

In the preferred but non-limiting example illustrated here, latch arrangement 600 includes a stop latch 610, deployed to assume a secured position (FIGS. 7A and 7B) in which stop latch 610 mechanically obstructs motion of locking element 606 to prevent displacement of the locking element to its unlocked position, thus serving as a "deadlock" in the sense that it prevents direct manual intervention of an unauthorized person trying to push the locking element out of its locking position. Stop latch 610 is displaceable, in this case by a pivotal motion, to a released position (FIG. 7C) in which locking element 606 is free to be displaced to its unlocked position.

An actuating mechanism mounted on panel 602 is configured to selectively displace stop latch 610 to the released position and to displace locking element 606 to the unlocked position.

In the non-limiting but preferred example illustrated here, stop latch 610 is pivotally mounted on locking element 606 via a pivot pin 612. In its secured position, an engagement portion 614 of stop latch 610 engages a corresponding ledge 616 which provides an abutment feature on frame element 604.

Figure 7A:
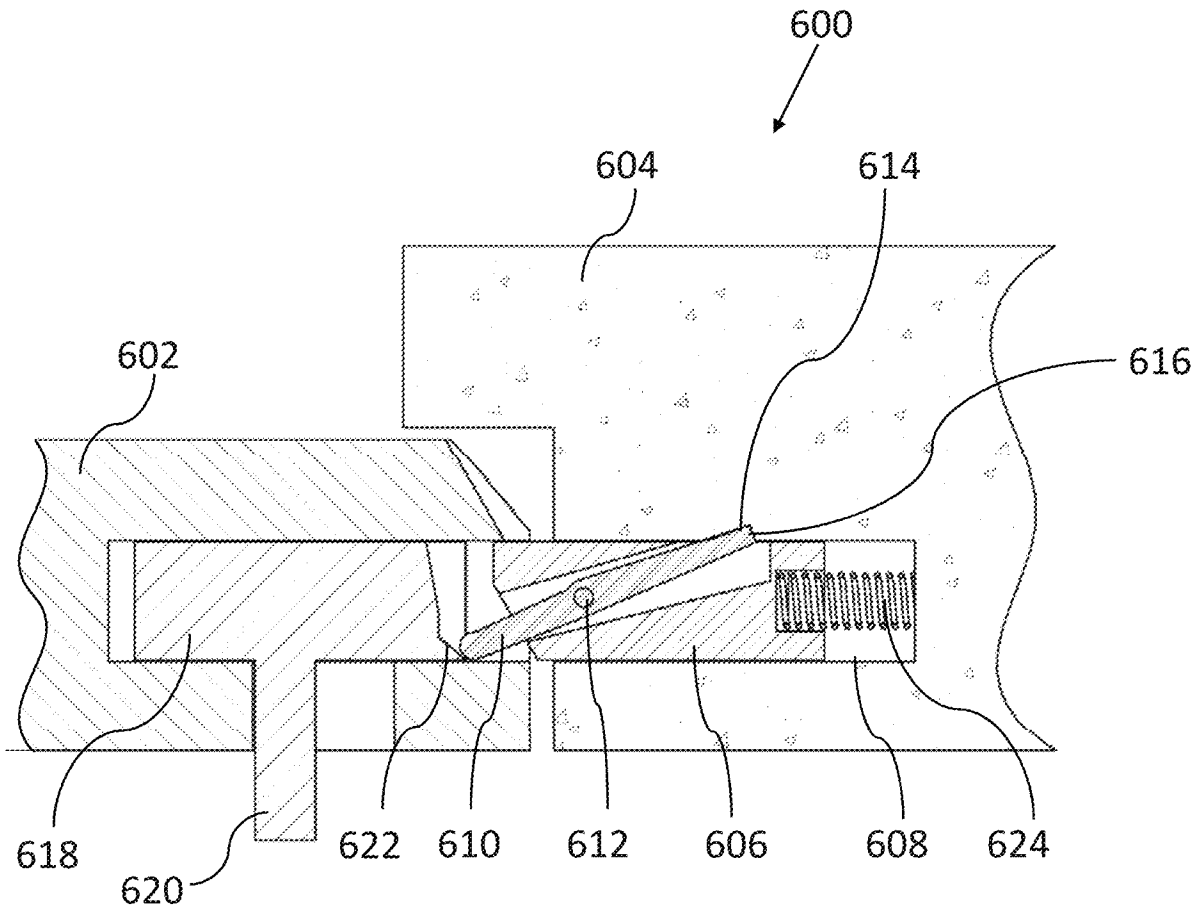
FIG. 7A is a schematic partial horizontal cross-sectional view taken through a latch arrangement according to an embodiment of the present invention employing a linearly-retractable locking element with a deadlock configuration.
Figure 7B:
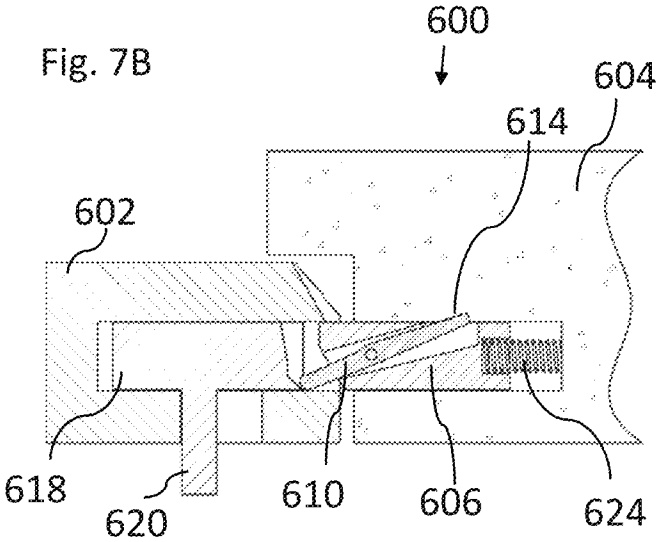
FIGS. 7B-7E are a sequence of views similar to FIG. 7A illustrating stages in the operation of a panel-mounted actuating mechanism to release the deadlock configuration and retract the locking element.
Figure 7C:
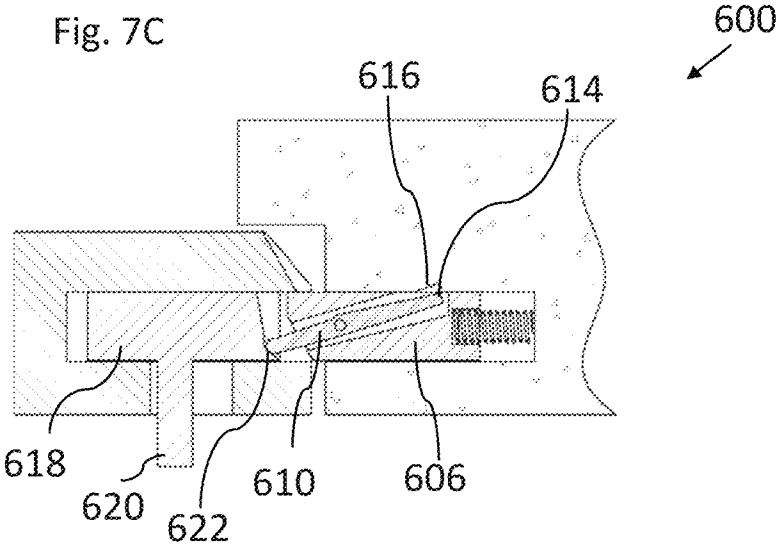
Figure 7D:
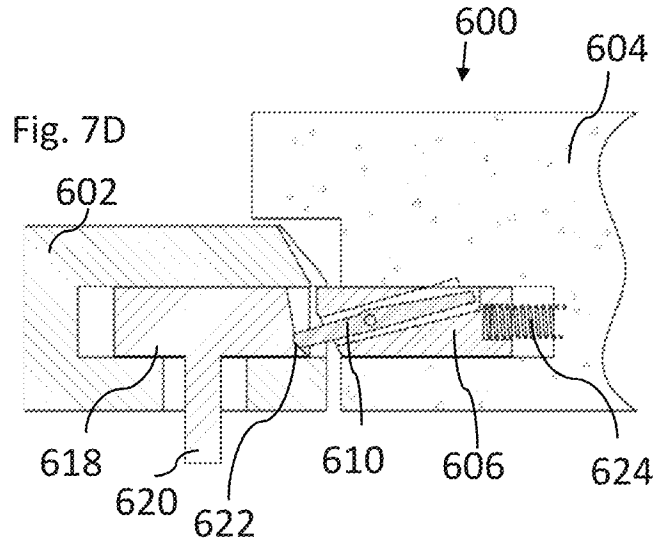
Figure 7E:
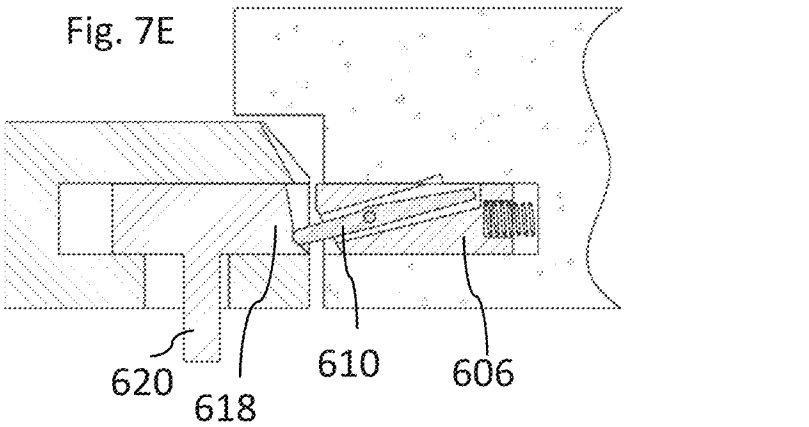

The actuating mechanism of panel 602 is here implemented as a sliding actuator 618 which is shown here displaced by a manually operated handle 620, but could alternatively be actuated by various other manual or powered mechanism. Sliding actuator 618 is here provided with a leading edge 622 which is shaped and deployed so as to engage a leading portion of stop latch 610 and pivot it to its released position (FIG. 7C). Further motion of sliding actuator 618 then bears, directly or indirectly, on locking element 606, causing it to retract against a spring element 624 until it is clear of the path for opening panel 602 (FIG. 7E), allowing opening of the door or window.

Figure 24:
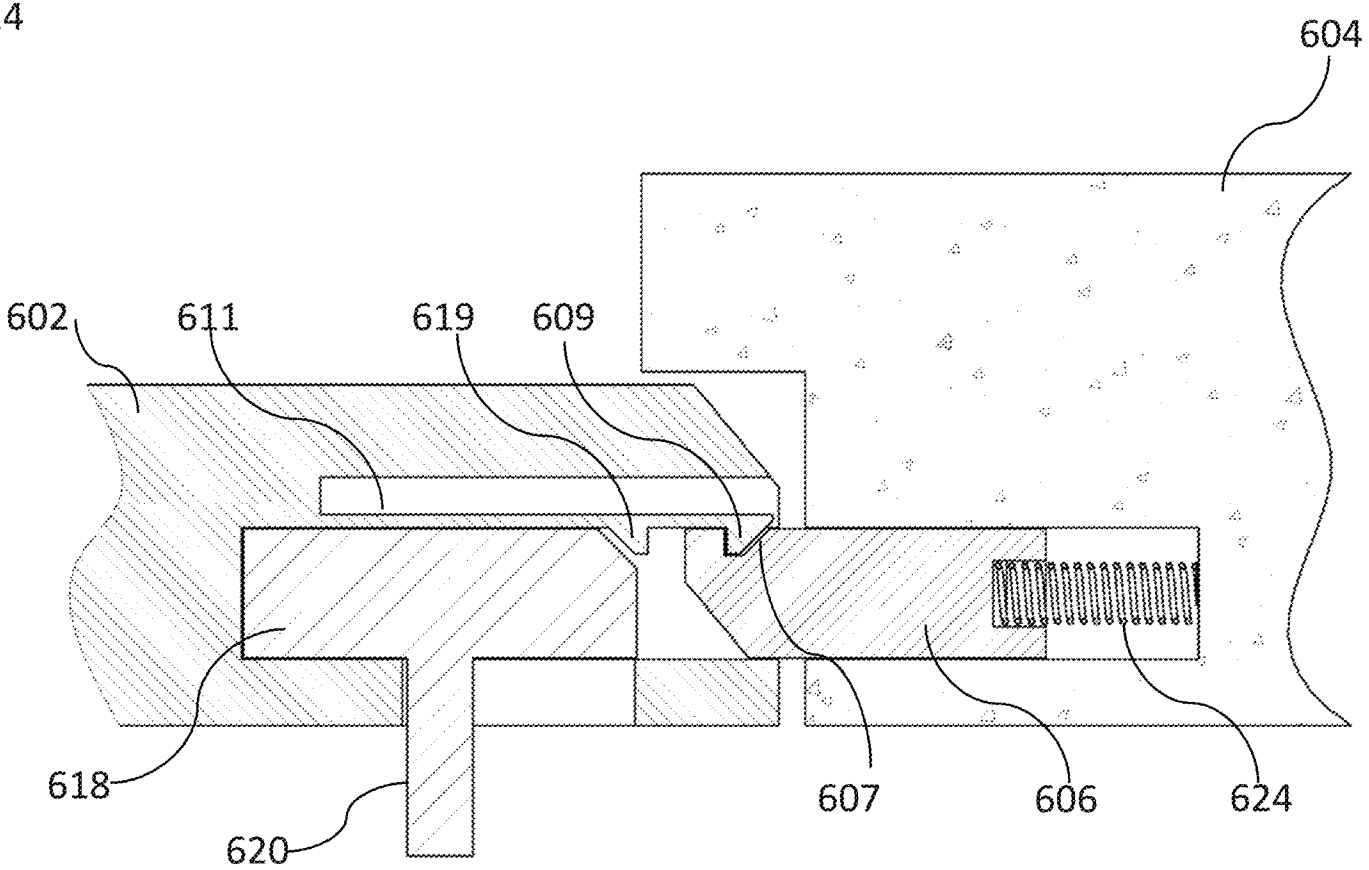
FIG. 24 is a schematic partial horizontal cross-sectional view taken through a further latch arrangement according to an embodiment of the present invention employing a linearly-retractable locking element with a deadlock configuration.

Although latch arrangement 600 is illustrated with a stop latch 610 that is mounted on locking element 606, it should be noted that the various stop latch embodiments of the present invention can be implemented using stop latch arrangements that are otherwise deployed, including stop latches deployed as part of the frame element and stop latches that are deployed within the panel. Furthermore, the motion of the stop latch itself may be any motion, including a linear motion, a rotating motion, and any combination or compound motion. By way of one further example, FIG. 24 shows a latch arrangement in which a stop latch is implemented as part of panel 602.

Specifically, in this case, locking element 606 is formed with a recess 607 which is engaged by a barbed projection 609 mounted on a leaf spring 611 within an internal volume of panel 602. When the panel is closed against the frame and locking element 606 engages a complementary channel in the panel, leaf spring 611 allows barbed projection 609 to ride over the leading edge of locking element 606 and to snap into engagement with recess 607, thereby retaining locking element 606 to provide deadlock functionality. When handle 620 is displaced to the right as shown, a part of sliding actuator 618 engages an abutment block 619, attached to or integrated with leaf spring 611, so as to lift the leaf spring and disengage barbed projection 609 from recess 607. This releases locking element 606 to be pushed back by further motion of sliding actuator 618.

Figure 8A:
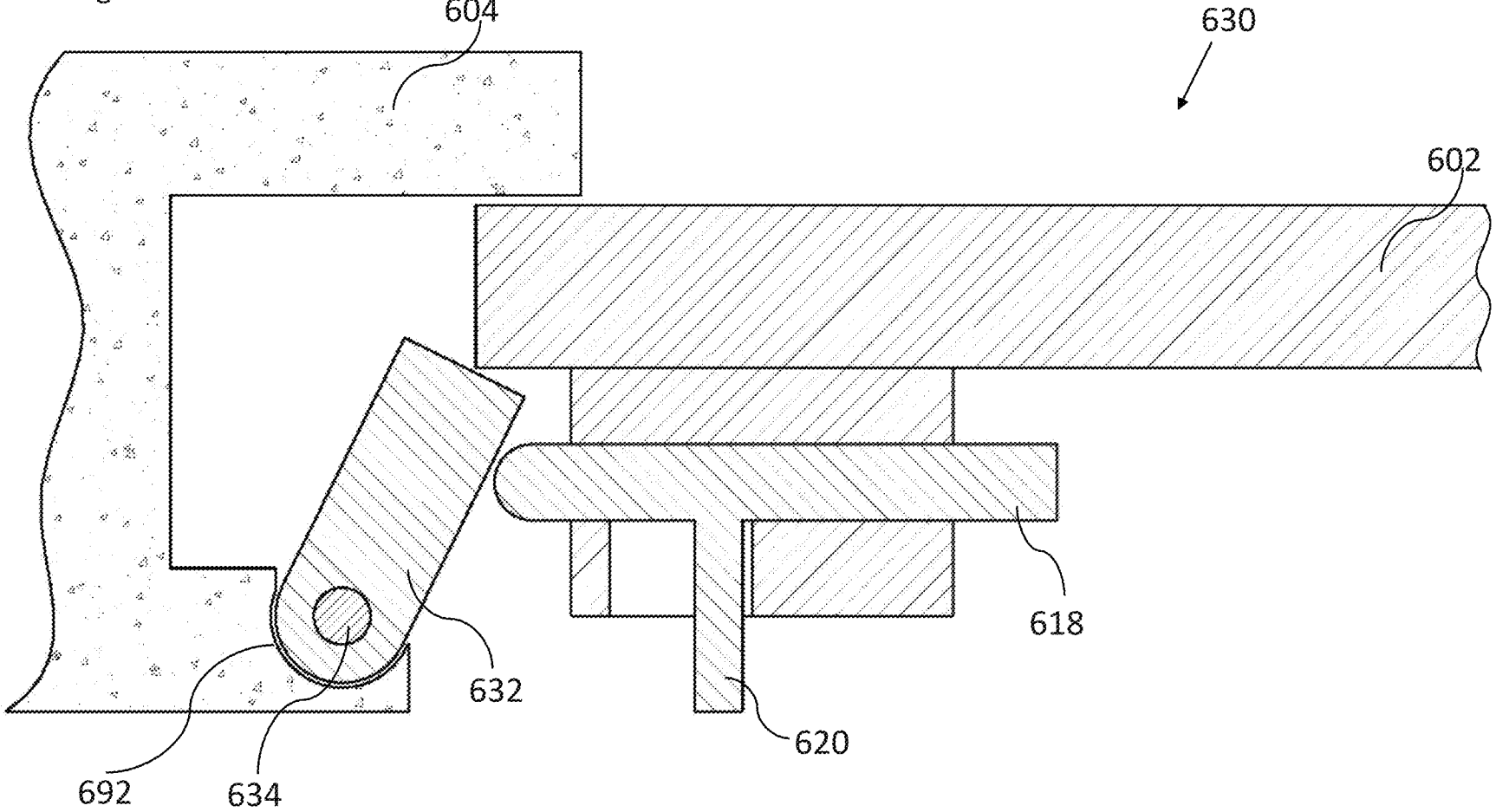
FIG. 8A is a schematic partial horizontal cross-sectional view taken through a latch arrangement according to an embodiment of the present invention employing a linearly-displaceable panel-mounted handle to release a pivotal frame-mounted locking element.
Figure 8B:
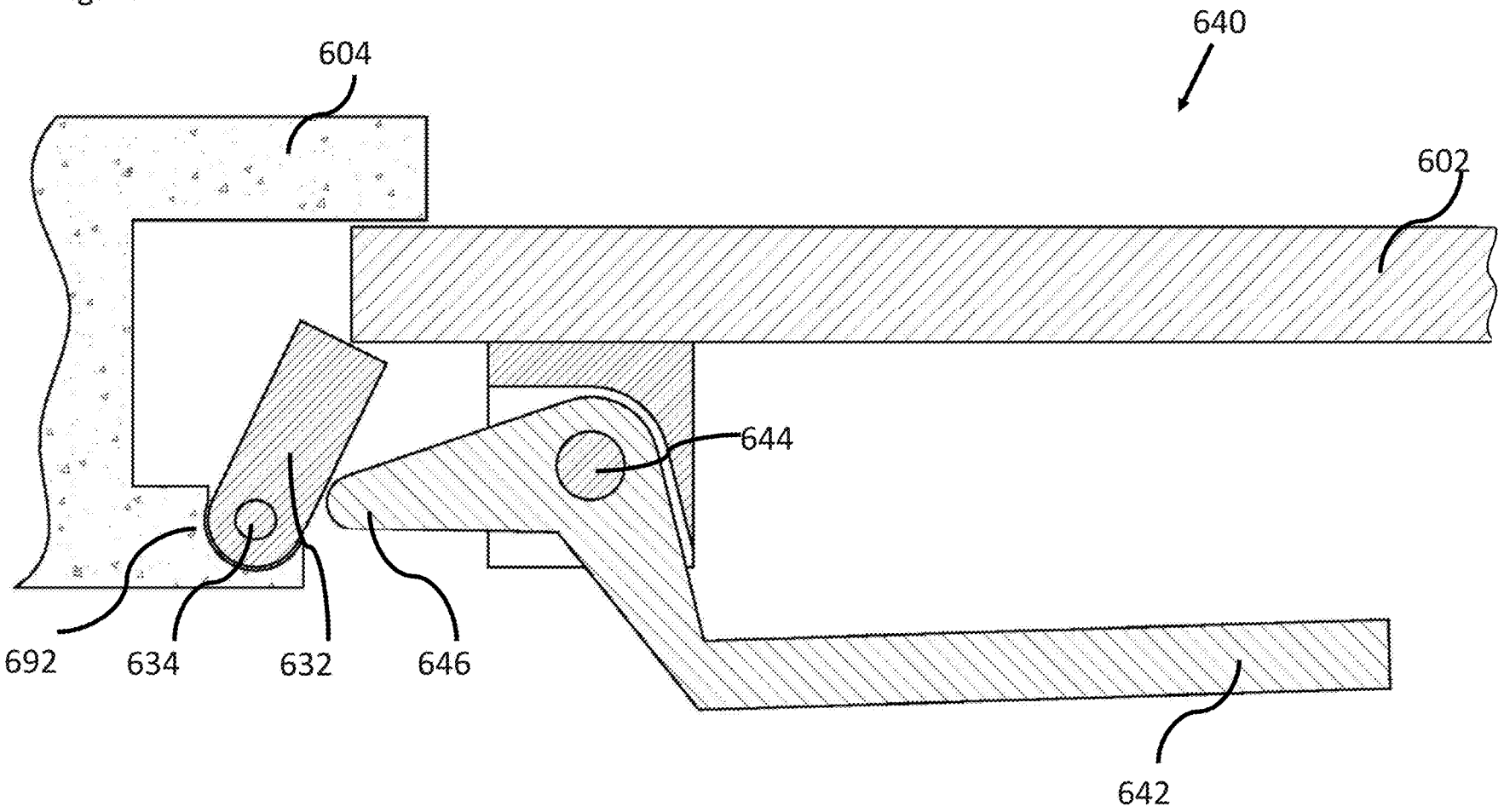
FIG. 8B is a schematic partial horizontal cross-sectional view taken through a latch arrangement similar to FIG. 8A but employing a pivotal panel-mounted handle.

Turning now to FIGS. 8A and 8B, a subset of implementations of the present invention relate to devices in which the locking element performs an unlocking motion which differs from the conventional sliding bolt motion in the plane of closure of the panel. In the example of latch arrangement 630 in FIG. 8A, the locking element 632 is configured to be displaced along an unlocking motion which includes a component of rotational motion and, in the particularly preferred example illustrated here, is a pivotal motion about an axis 634. In the locked position illustrated here, locking element 632 engages part of panel 602 so as to prevent opening of the panel away from the frame element 604. Locking element 632 can be displaced away from its locked position through a pivotal motion about axis 634 so as to enable opening of the panel. Displacement of locking element 632 is actuated by sliding an actuator bolt 618 by use of handle 620, similar to that shown in FIG. 7A.

FIG. 8B illustrates a latch arrangement 640 that is generally similar to that of FIG. 8A, with equivalent components labeled similarly. In this case, the panel-mounted actuator is a pivotally-mounted handle 642 mounted so as to pivot about an axis 644 to that an actuator tip 646 selectively bears on a surface of locking element 632 to displace the locking element from its locked position as shown to an unlocked position. It should be noted, parenthetically, that latch arrangement 640, and various other examples illustrated herein, are shown only schematically to illustrate the principles of operation while omitting various return springs and the like which would be typically be included in a deployed device. All such details will be self-explanatory to a person having ordinary skill in the art.

Figure 9:
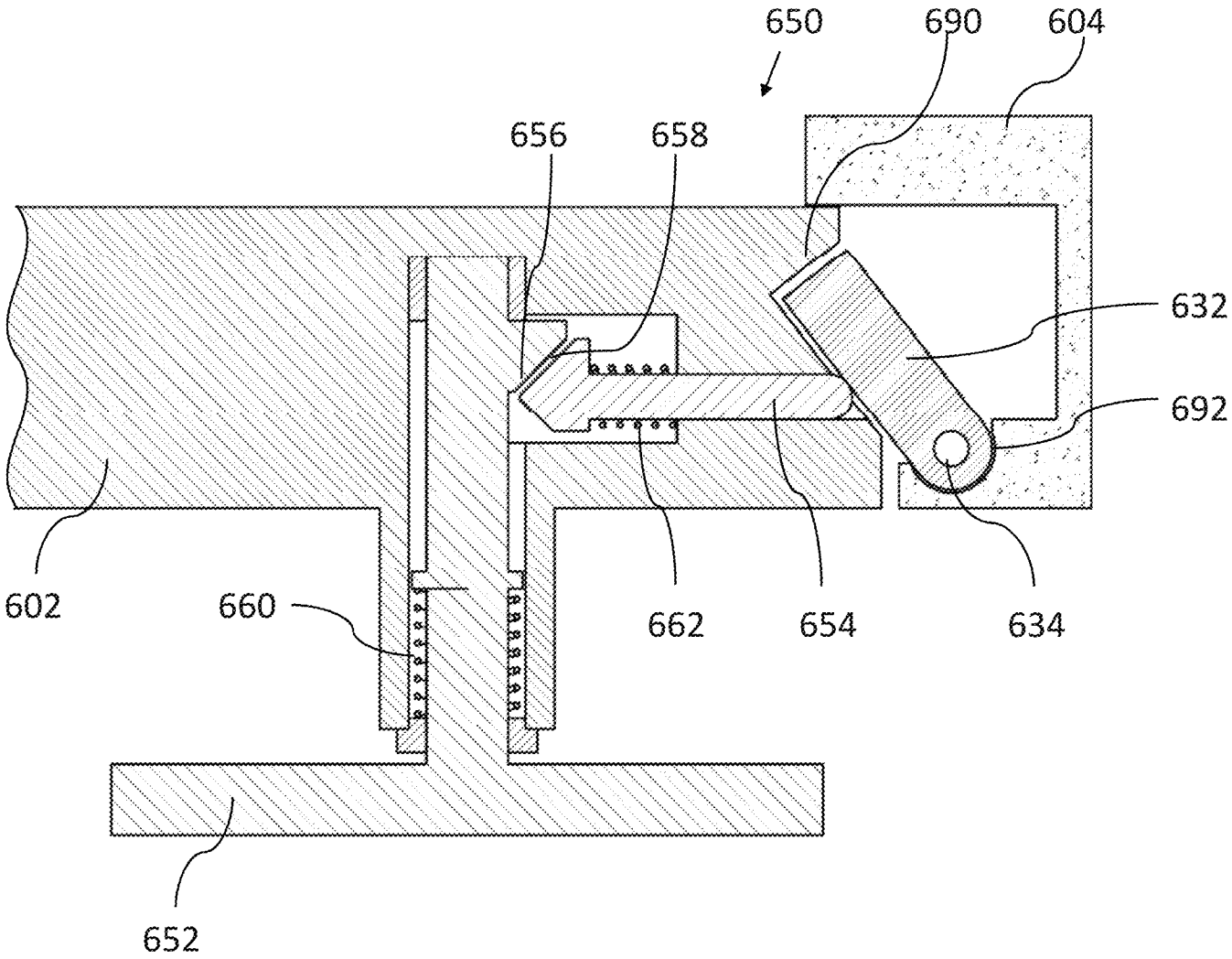
FIG. 9 is a schematic partial horizontal cross-sectional view taken through a latch arrangement according to an embodiment of the present invention illustrating a further panel-mounted actuating mechanism for releasing a frame-mounted locking element.

The examples of FIGS. 8A and 8B both employed an actuating element which was integrated to move as part of a handle. It should be noted however that the actuating element and a manual handle need not be rigidly interconnected, and need not undergo the same motion. By way of example, FIG. 9 illustrates an alternative implementation of a latch arrangement 650 with a pull-to-open handle 652 which operates a sliding actuator 654 to selectively displace locking element 632 from its locked position to an unlocked position. In the example shown here, pulling of handle 652 in a direction generally perpendicular to the plane of the panel causes an inclined actuator surface 656 to bear on a complementary bearing surface 658 of sliding actuator 654, thereby displacing the sliding actuator. Springs 660 and 662 return the respective actuator arrangement components to their rest positions.

It should be noted that implementations of the present invention using manually operated handles may be operated by any direction and type of handle motion desired. Options include handles that are pulled away from the panel, pushed towards the panel, slid horizontally or vertically in the plane of the panel, rotated about an axis parallel or perpendicular to the plane of the panel, or any other type of motion or combination of types of motion desired.

Figure 10:
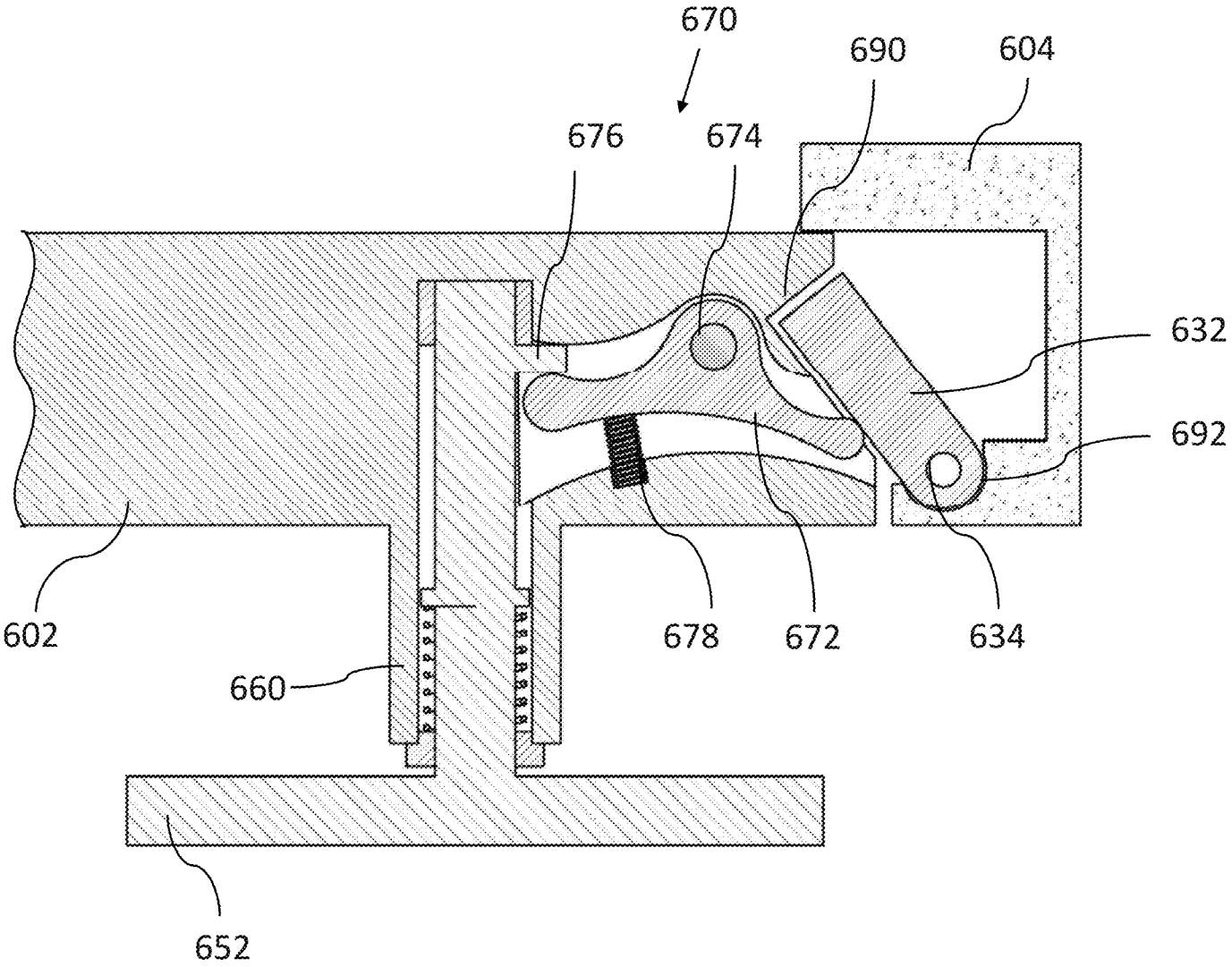
FIG. 10 is a view similar to FIG. 9 illustrating a further implementation of an actuating linkage between the handle and the locking element.

FIG. 10 illustrates a further variant latch arrangement 670, which is essentially similar in structure and function to latch arrangement 650, with similar components labeled similarly. Latch arrangement 670 differs from latch arrangement 650 in that the linear motion of handle 652 is here converted to a rotary rocking motion of a pivotal actuating element 672 mounted on a pivot 674. Pulling of handle 652 draws a ridge 676 of a handle shaft to bear on one extremity of pivotal actuating element 672, thus casing the element to rock so that the opposite extremity bears on a flank of locking element 632, thereby displacing it to an unlocked position. A return spring 678 biases the pivotal actuating element back to its rest position.

Figure 11A:
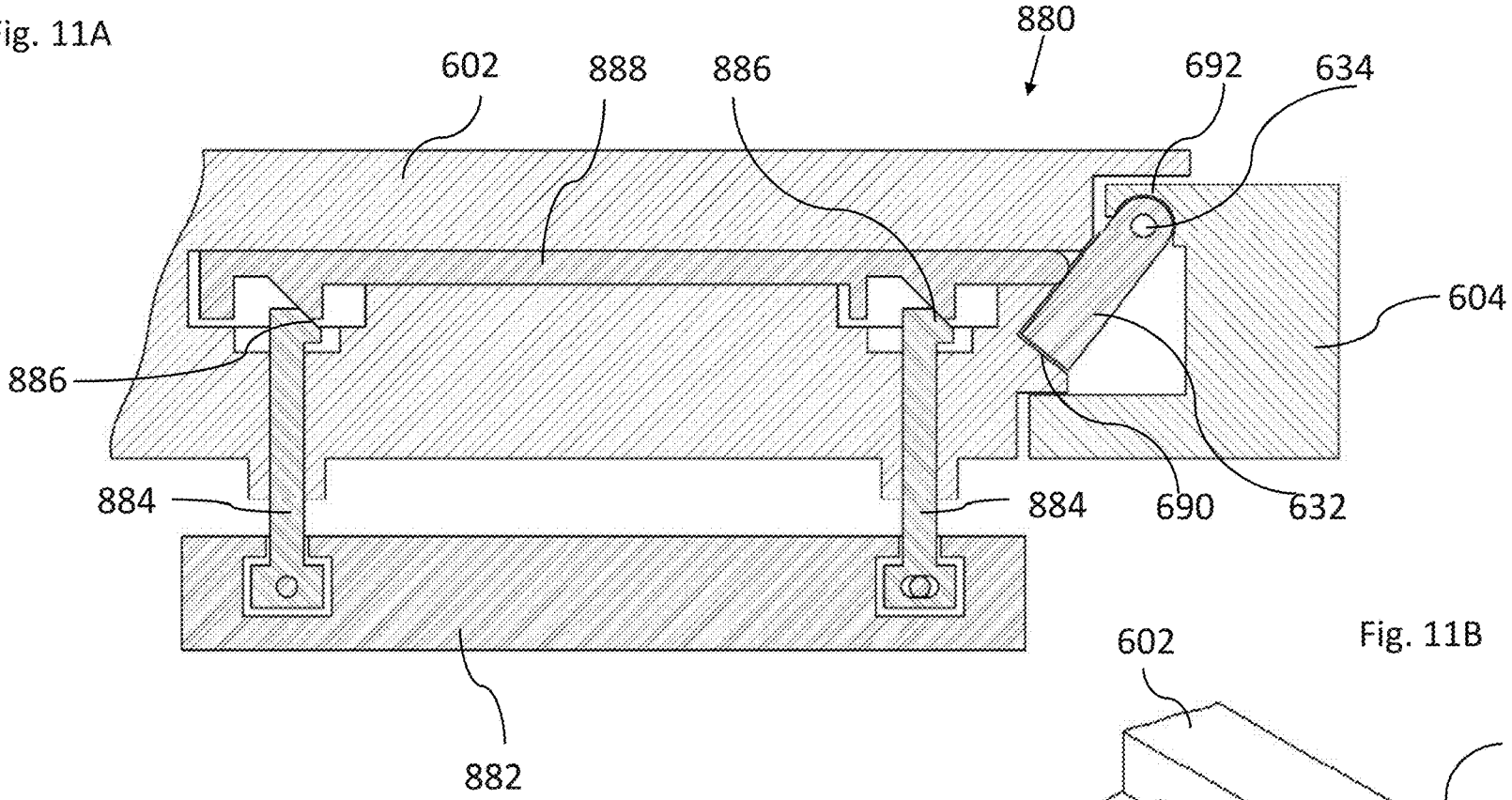
FIG. 11A is a schematic partial horizontal cross-sectional view taken through a latch arrangement according to an embodiment of the present invention suitable for implementing a push-bar release mechanism.
Figure 11B:
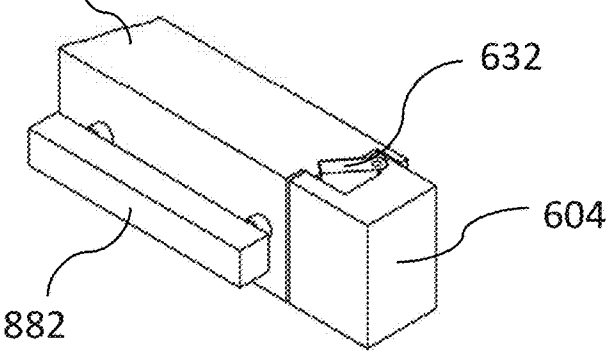
FIG. 11B is a schematic partial cut-away isometric view of the latch arrangement of FIG. 11A.

FIGS. 11A and 11B illustrate the application of principles similar to FIG. 9 for implementation of a latch arrangement 880 for a push-bar emergency escape or "panic door" in which force applied to a push-bar 882 towards the panel is effective to release locking of the panel to allow outwards opening of the panel. In the implementation illustrated here, push-bar 882 is mounted on actuator rods 884 which terminate in laterally inclined actuator surfaces 886 which engage complementary inclined bearing surfaces of a lateral-sliding internal actuator bar 888, deployed to displace locking element 632. A further non-limiting example of a panic door implementation will be described below with reference to FIGS. 5A-5E.

Figure 12C:
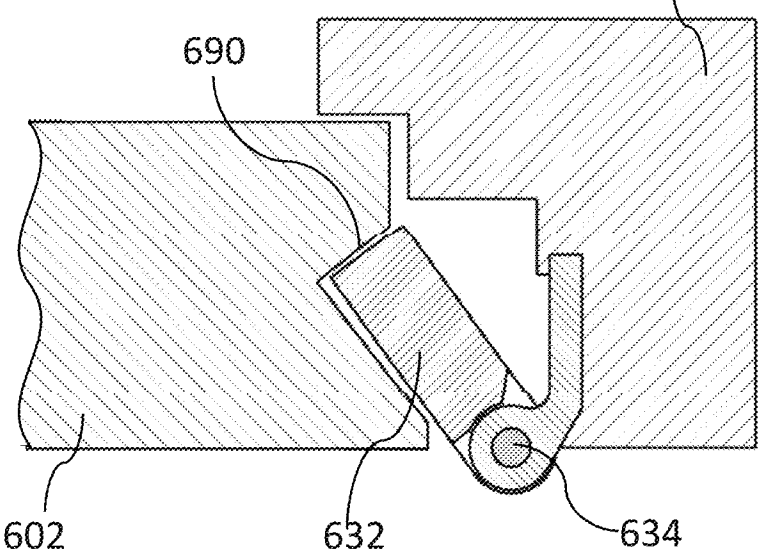
FIG. 12C is a schematic partial horizontal cross-sectional view taken through a latch arrangement employing the locking element structure of FIG. 12A.
Figure 12A:
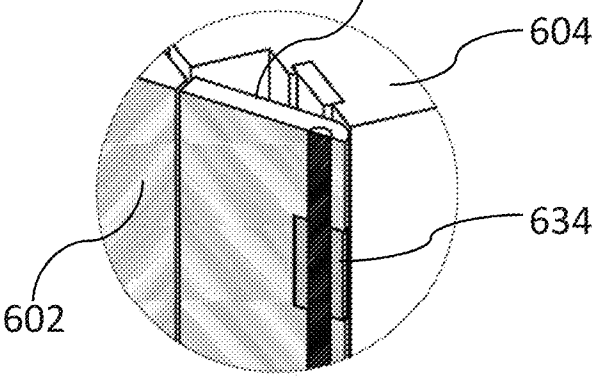
FIG. 12A is a schematic partial cross-sectional view taken along a center plane of a pivotal locking element for use in various embodiments of the present invention, illustrating a form of attachment of the locking element to a frame element.
Figure 12B:
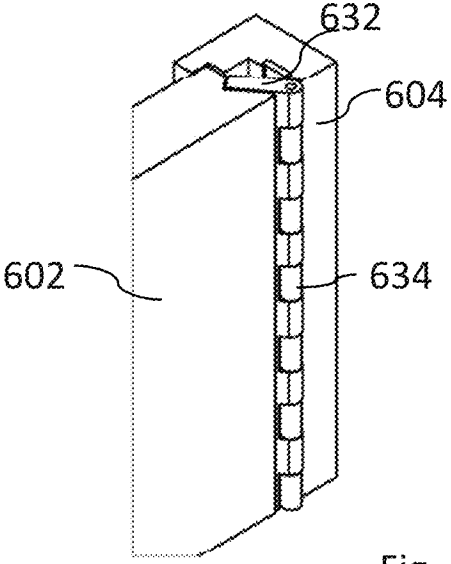
FIG. 12B is a schematic partial isometric view of a latch arrangement employing the locking element structure of FIG. 12A.

Various additional options regarding a configuration of a locking element for use in embodiments of the present invention are illustrated in FIGS. 12A-12C. The option of a locking element that is disposed at an oblique angle with respect to the panel when in the locked state provides significant advantages in that forces acting on the panel to try to open the panel away from the frame element are converted primarily, if not exclusively, into compressive forces on the locking element. This provides enhanced security of locking for a given locking element compared to a similar locking element that is exposed to bending or shear forces (that commonly dominate in conventional bolts). When combined with the use of a locking element which is elongated along a significant portion (typically at least 10%, and in some cases along a majority) of a dimension of the panel, this configuration results in highly secure locking, even when using relatively soft materials. Thus, according to certain preferred embodiments of the present invention, the locking element may in fact be formed from relatively soft materials, such as various polymer materials, and may employ various combinations of materials as layers, coatings or composites.

In order to spread the compressive forces applied to the locking element, panel 602 may advantageously be formed with a pressure surface 690 oriented at an inclination to the plane of closure of the panel so that force applied to displace the panel towards an opening direction of the panel applies compressive forces acting through locking element 632. This pressure surface geometry is seen in many of the exemplary implementations of the present invention illustrated herein, including FIGS. 9-23.

There are a number of options to oppose the compressive forces applied to locking element 632 on the side of frame element 604. For pivotally-mounted locking elements which move on a hinge axis 634, the hinge axis is typically not relied upon for bearing major loading. Accordingly, in the implementations of 8A-11B, a region of locking element 632 around hinge 634 is formed with a radius of curvature which matches to a partial cylindrical support wall 692 formed as part of frame element 604. In these cases, whenever significant force is applied to panel 602 while locked, slight flexing of hinge 634 allows closure of the small clearance gap between locking element 632 and support wall 692 so that most of the load is transferred directly by compressive forces to support wall 692.

As an alternative, FIGS. 12A-12C illustrate an implementation in which hinge 634 is implemented as a load-bearing hinge, optionally of a type commonly referred to as a "piano hinge" (borrowed from its usage to support the heavy lids of grand pianos) which runs continuously along a length of locking element 632. The second wing of the hinge is fixed firmly to frame element 604. By suitable choice of the hinge material, design and dimensions, it is possible to provide sufficient load bearing capability to withstand a wide range of expected loads for each given application.

Figure 13B:
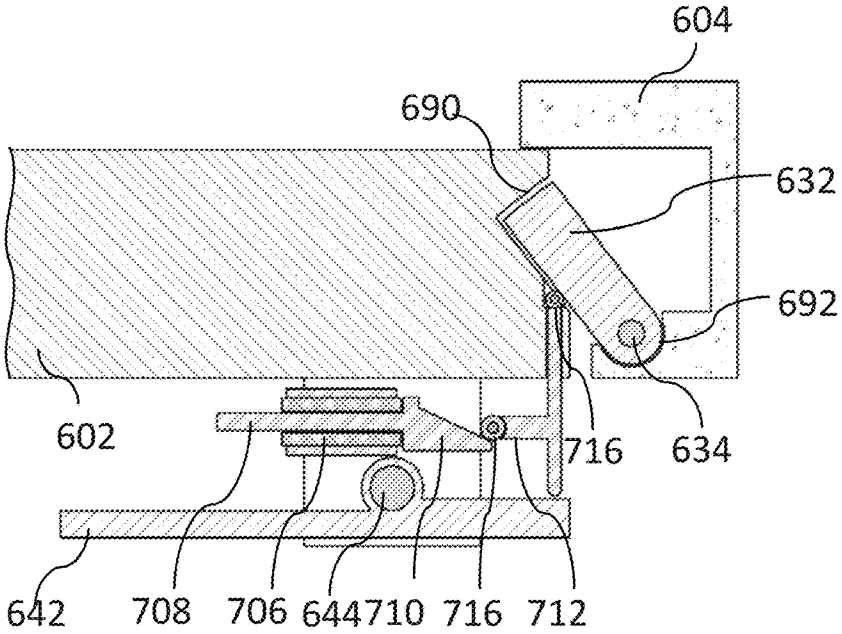
FIG. 13B is a view similar to FIG. 13A illustrating a variant implementation of the latch arrangement with addition of friction-reducing roller elements.
Figure 13A:
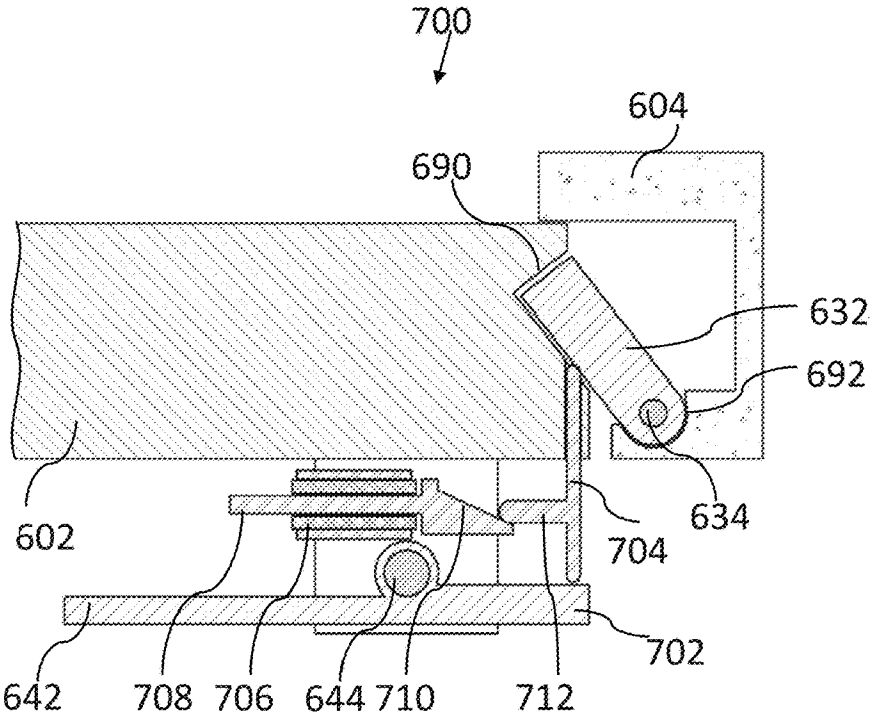
FIG. 13A is a schematic partial horizontal cross-sectional view taken through a latch arrangement according to an embodiment of the present invention providing both a panel-mounted handle and a panel-mounted powered actuator to release a frame-mounted locking element.
Figure 14:
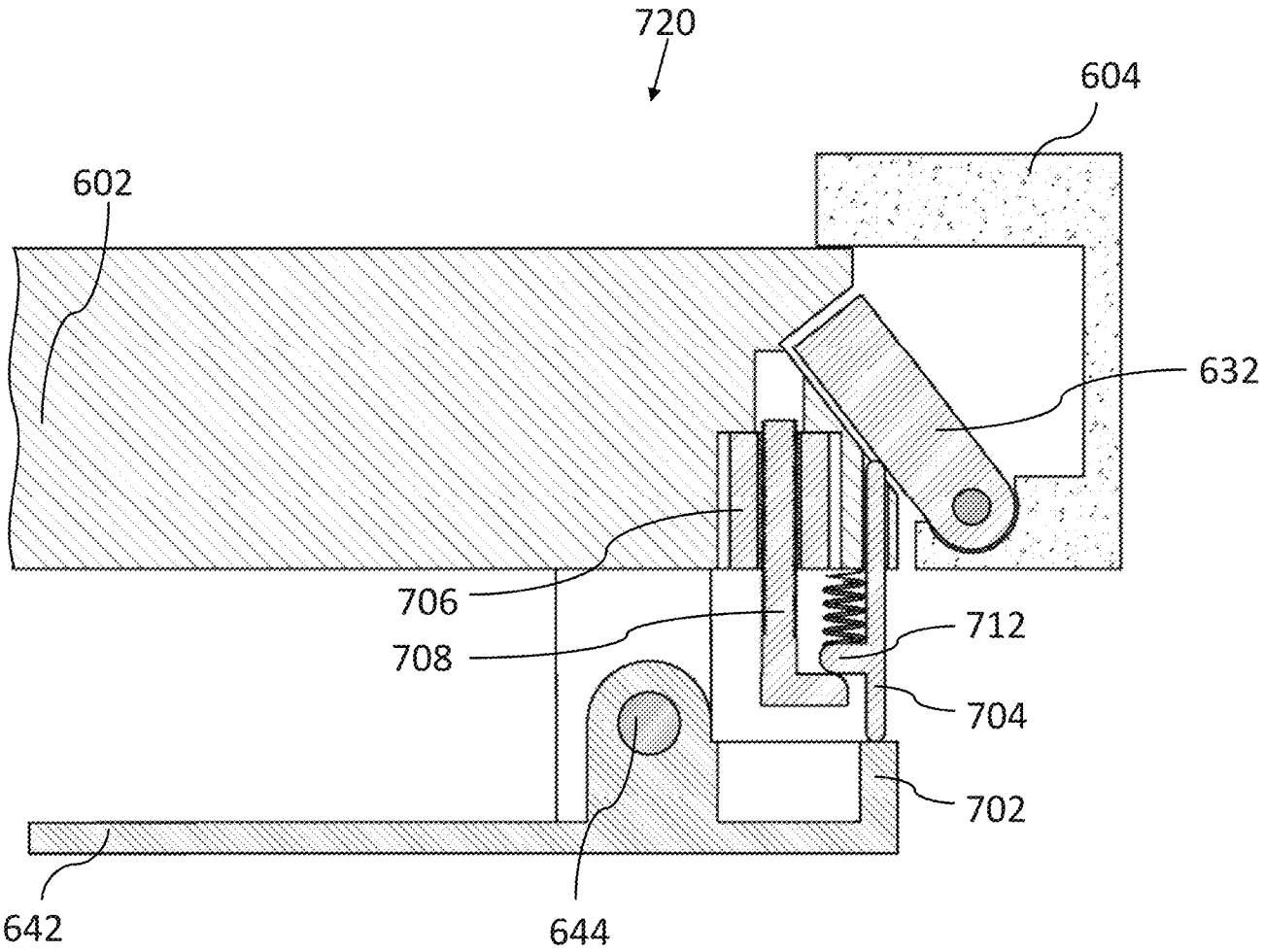
FIG. 14 is a schematic partial horizontal cross-sectional view taken through a latch arrangement according to a further embodiment of the present invention providing both a panel-mounted handle and a panel-mounted powered actuator to release a frame-mounted locking element.

Turning now to FIGS. 13A-14, it should be noted that the panel-mounted actuating mechanisms of the present invention may include any combination of manually operated handles, key-operated mechanisms, and powered actuator mechanisms (e.g., electrically powered, hydraulic or pneumatic). FIGS. 13A-14 illustrate examples in which a manually operated handle is combined with a powered actuator.

Referring specifically to FIG. 13A, this illustrates a latch arrangement 700 which includes a pivotally mounted handle 642 mounted on pivot axis 644 so that, when pulled away from panel 602, an actuating region 702 bears on a displaceable actuator element 704 so as to bear on locking element 632 and displace it from its locked position as shown to an unlocked position. In this case, motion of actuator element 704 occurs in a direction generally perpendicular to a plane of closure of panel 602 within the frame. In addition to the manually operable handle, latch arrangement 700 includes a powered actuator 706, for example, an electrically operated actuator, which is deployed to provide a release mechanism independently controllable to displace locking element 632 to an unlocked position. A wide range of types of electrically operated actuator may be used, including but not limited to, solenoids and various motor-operated mechanisms. In order to simplify the structure and reduce the total number of components, actuator 706 is here configured to displace the same actuator element 704 as is displaced by handle 642. Thus, actuator 706 is here shown with a rod 708 terminating in an inclined actuator surface 710 which bears on a projection 712 of actuator element 704 such that displacement of rod 708 parallel to the plane of closure causes actuator surface 710 to push actuator element 704 transversely, roughly perpendicular to the plane of closure, to press against locking element 632 and displace the locking element towards the unlocked position. Clearly, a separate actuation linkage could be provided between the powered actuator and locking element 632 if that is preferred for any reasons.

Provision of a powered actuator to release locking of the panel may be useful in a range of circumstances where local or remote electronic control, or other remote control, is required. Examples include but are not limited to: push-button release systems, intercom systems, keypad code-operated systems, smart card and wireless access control systems, and various emergency access and emergency building evacuation arrangements. The additional system components (e.g., power supply, logic controller and communication interfaces) required to support all such applications are well known in the art, and will not be addressed here in detail. FIG. 13B shows a latch arrangement 714 similar to that of FIG. 13A, but illustrating addition of rollers 716 at the extremities of actuator element 704 in order to reduce friction between inclined actuator surface 710 and projection 712, and between actuator element 704 and locking element 632. The rollers may be implemented using any rolling element which is effective to reduce friction. Most preferably, a ball bearing assembly or cylindrical roller bearings are used for highly effective friction reduction. Such bearings per se are well known, and will not be described here in detail. It should be understood that roller elements or bearings of this type may be included with any of the embodiments of the present invention described herein, as will be clear to a person ordinarily skilled in the art.

Turning now to FIG. 14, this illustrates a latch arrangement 720 which is essentially similar to latch arrangement 700, but illustrates an alternative deployment of the powered actuator 706 where the direction of action of the actuator is perpendicular to the plane of closure, and parallel to the direction of motion of actuator element 704.

Figure 15:
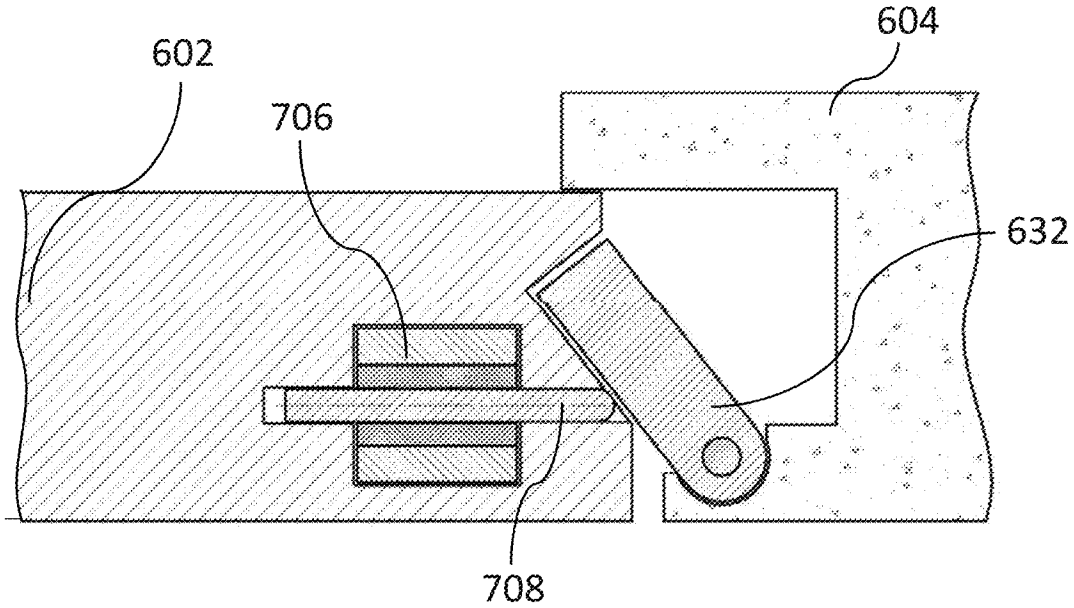
FIG. 15 is a schematic partial horizontal cross-sectional view taken through a latch arrangement according to an embodiment of the present invention providing a panel-mounted powered actuator to release a frame-mounted locking element.
Figure 16:
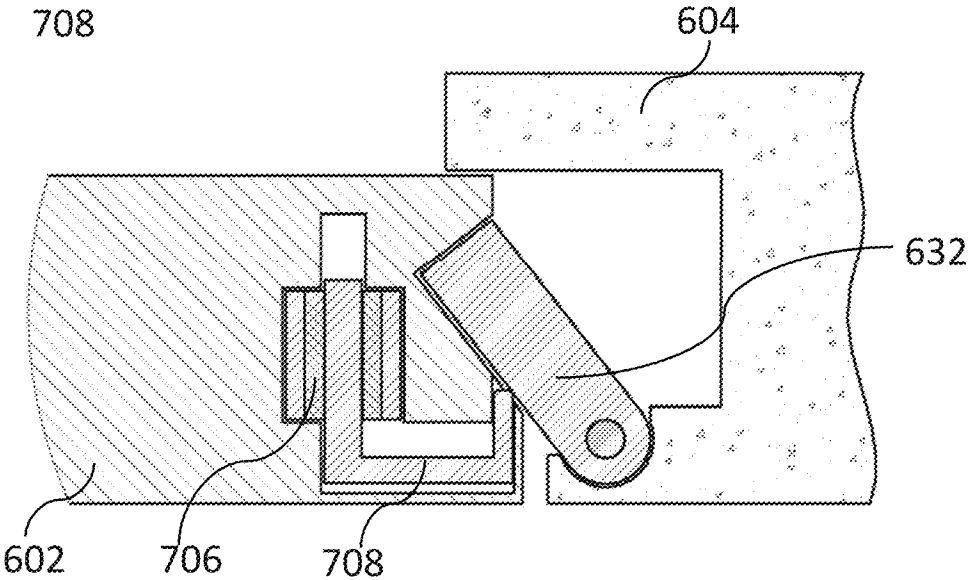
FIG. 16 is a view similar to FIG. 15 illustrating an alternative configuration of the powered actuator.
Figure 17B:
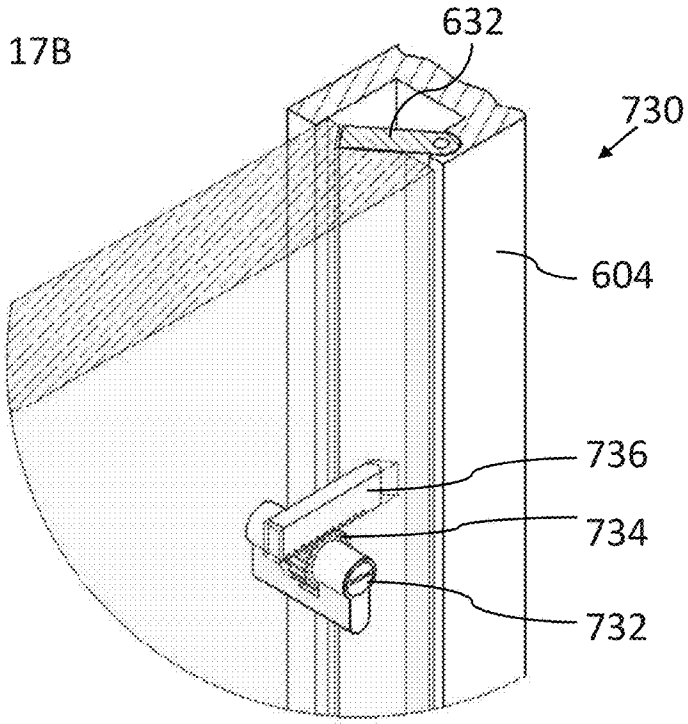
FIGS. 17A and 17B are schematic cut-away isometric views of a latch arrangement according to an embodiment of the present invention providing a panel-mounted cylinder lock to release a frame-mounted locking element, the views being taken from first and second sides of a locked panel, respectively.
Figure 17D:
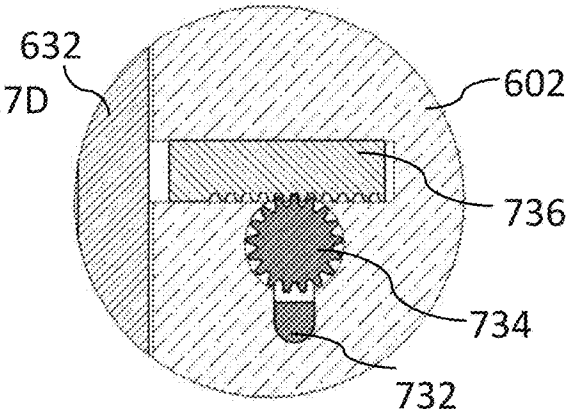
FIG. 17D is a schematic partial vertical cross-sectional view taken through the latch arrangement of FIG. 17A.
Figure 17A:
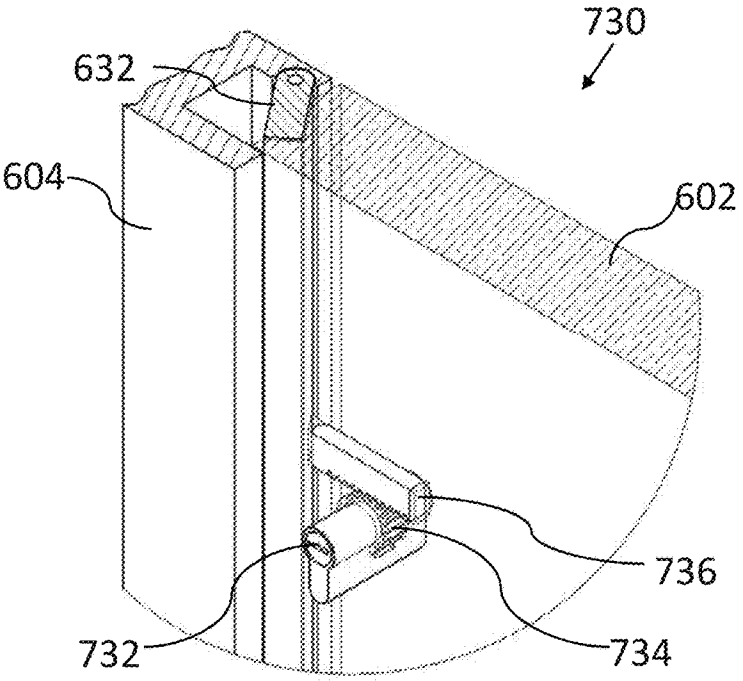
Figure 17C:
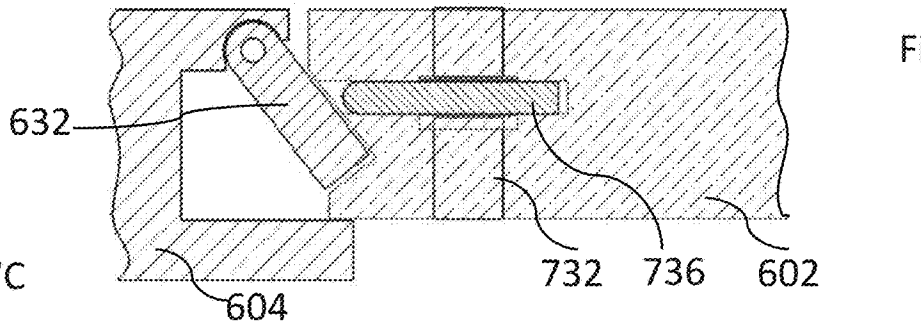
FIG. 17C is a schematic partial horizontal cross-sectional view taken through the latch arrangement of FIG. 17A.
Figure 18C:
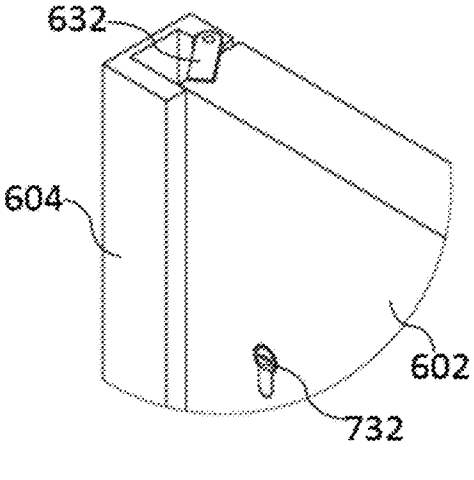
FIG. 18C is a partial isometric view of the latch arrangement of FIG. 18A.
Figure 18B:
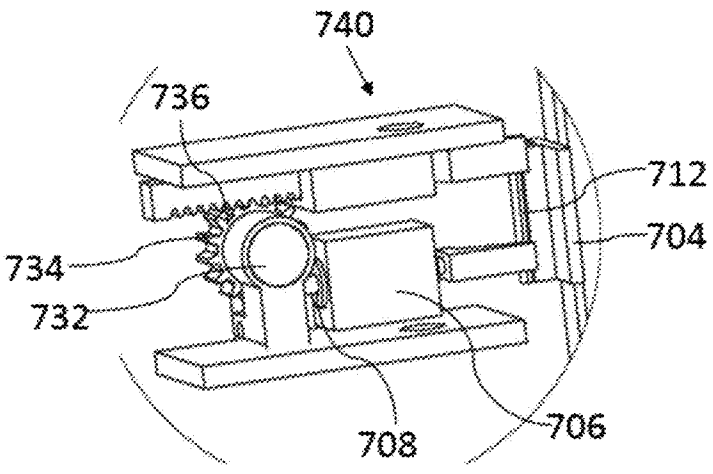
FIG. 18B is a view similar to FIG. 18A with the handle removed to reveal components of the latch arrangement.
Figure 18A:
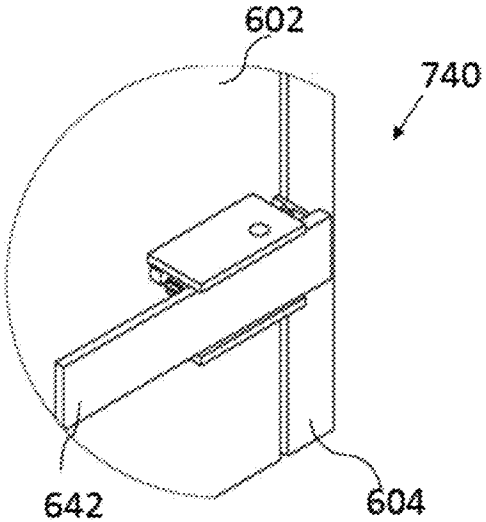
FIG. 18A is a schematic partial isometric view of a latch arrangement according to an embodiment of the present invention providing operation by a manually operated handle, a powered actuator and a cylinder lock.
Figure 18E:
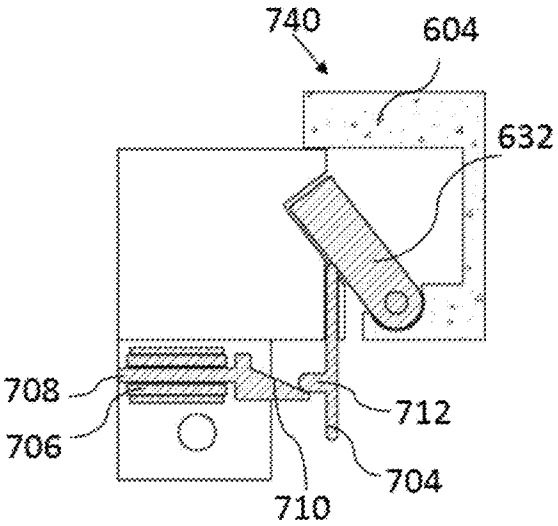
FIGS. 18D and 18E are partial horizontal cross-sectional views taken respectively through a cylinder lock-driven actuator and through a powered actuator of FIG. 18A.
Figure 18D:
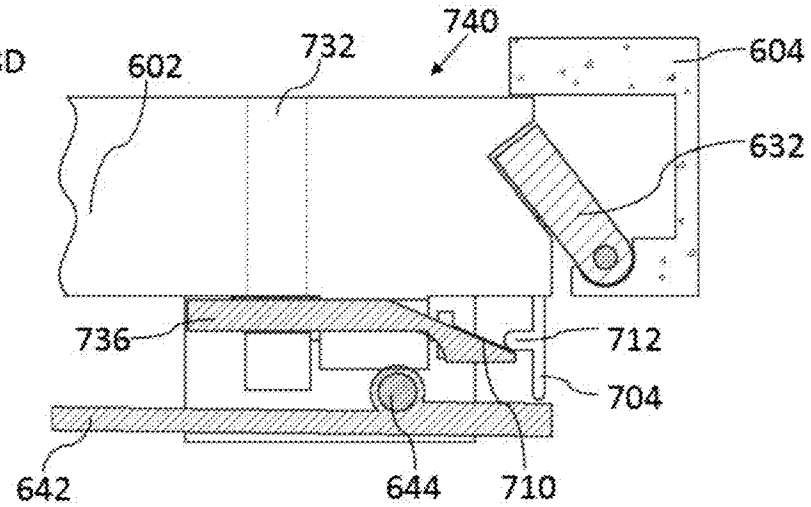
Figure 19:
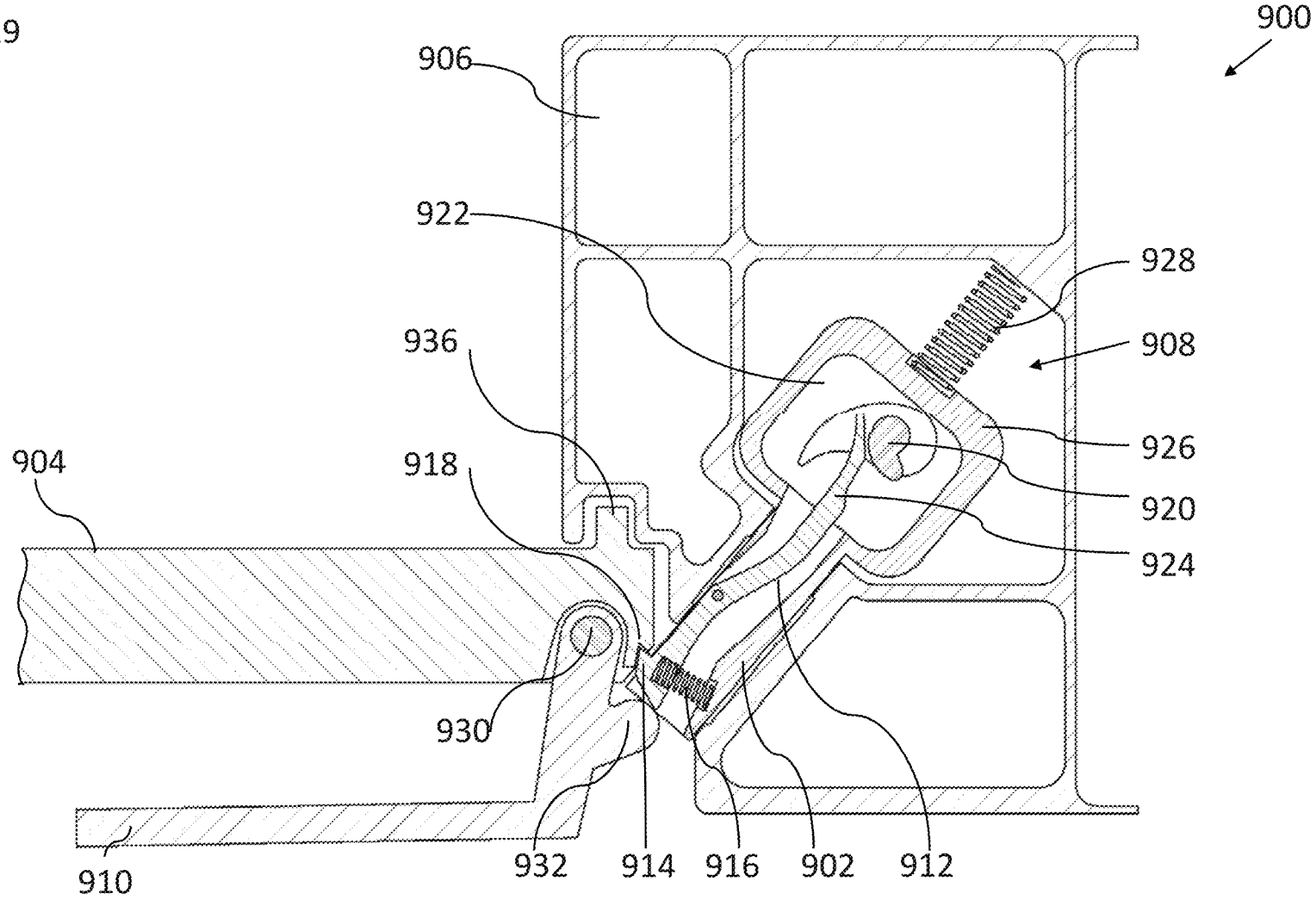
FIG. 19 is a schematic partial horizontal cross-sectional view taken through a latch arrangement according to an embodiment of the present invention employing a retractable locking element movable in a direction oblique to the plane of closure of the panel.

Turning now to FIGS. 15 and 16, it should be noted that the present invention is also applicable to cases where a powered actuator is the sole actuation mechanism in panel 602. In the case of FIG. 15, the direction of action of powered actuator 706 is parallel to the plane of closure, whereas in FIG. 16, the direction of action is perpendicular to the plane of closure. Either orientation, as well as a wide range of other orientations, can be implemented in a manner that is effective to allow a suitably shaped actuator rod 708 to directly or indirectly displace locking element 632 from its locked position towards its unlocked position.

Turning now to FIGS. 17A-17D, a further set of options for implementing the panel-mounted actuating mechanism is by use of a lock cylinder. These drawings illustrate an implementation of a latch arrangement 730 according to an embodiment of the present invention in which a lock cylinder 732 is deployed within panel 602. The lock cylinder may be a double-ended cylinder providing a key channel accessible from each side of the door as shown, or one side of the door may be provided with a manual knob for turning the cylinder without a key from within a protected space. A further option employs a half-length cylinder which is accessible from only one side of the panel. The output gear 734 of cylinder 732 is shown here engaged with a toothed actuator element 736, which is advanced linearly by turning of the cylinder so as to bear on locking element 632 to displace it from its locked position to an unlocked position. Clearly, other mechanical linkages with arcuate or other more complex motion may equally be used to transfer the cylinder rotation to displacement of the locking element.

Cylinder 732 may advantageously be implemented as a cylinder that is limited in motion to a part of a revolution, and optionally with a spring deployed to bias the cylinder to return to its initial non-unlocking state, such that the latch arrangement by default locks itself whenever the panel is closed. Alternatively, for certain applications, a second stable state allowing removal of a key may be provided in which actuator element 736 remains in an unlocking state, creating a non-locking state of the door or window.

Turning now to FIGS. 18A-18E, there is shown an example of a latch arrangement 740 which essentially combines the features of latch arrangements 700 and 730 to provide capabilities of unlocking by a manual handle from one side, a key-operated cylinder lock from the other and a powered actuator for electronic or other remote operation. Similar reference numerals are used for the components as already described in FIGS. 13A and 17A-17D. As in all embodiments of the present invention, when described as "mounted on the panel", the various components may be mounted on an external surface of the panel and/or within an inner volume of the panel. In the example illustrated here, most of the components are mounted on an inside surface of the panel, where they are hidden behind handle 642 (which has been omitted from FIG. 18B for clarity). Lock cylinder 732 traverses the panel and provides its output gear 734 at the opposite surface from the key slot. In this case, both actuator rod 708 and toothed actuator element 736 are formed with inclined actuator surfaces 710 deployed for acting independently on actuator element 704.

Although FIGS. 8A-18E have been illustrated schematically in implementations without details of a stop latch ("deadlock") mechanism, it should be noted that each of these implementations is most preferably implemented in combination with a deadlock configuration, such as one of those described in the following embodiments.

FIG. 2A to 2E illustrates another example of a door or a window having latch arrangement 51 configured for fastening a panel 50 to a frame element 52. According to the present example the panel 50 is a panel of a hinged door and is configured to abut, in the closed state thereof, against a shoulder portion 54 defined on the frame element 52. The frame element 52 further defines a housing 55 for holding therein the latch arrangement 51, such that the frame facing portion 57 of the door panel 50 can be engaged by the latch arrangement 51, when the door is in the closed state thereof.

Figure 2A:
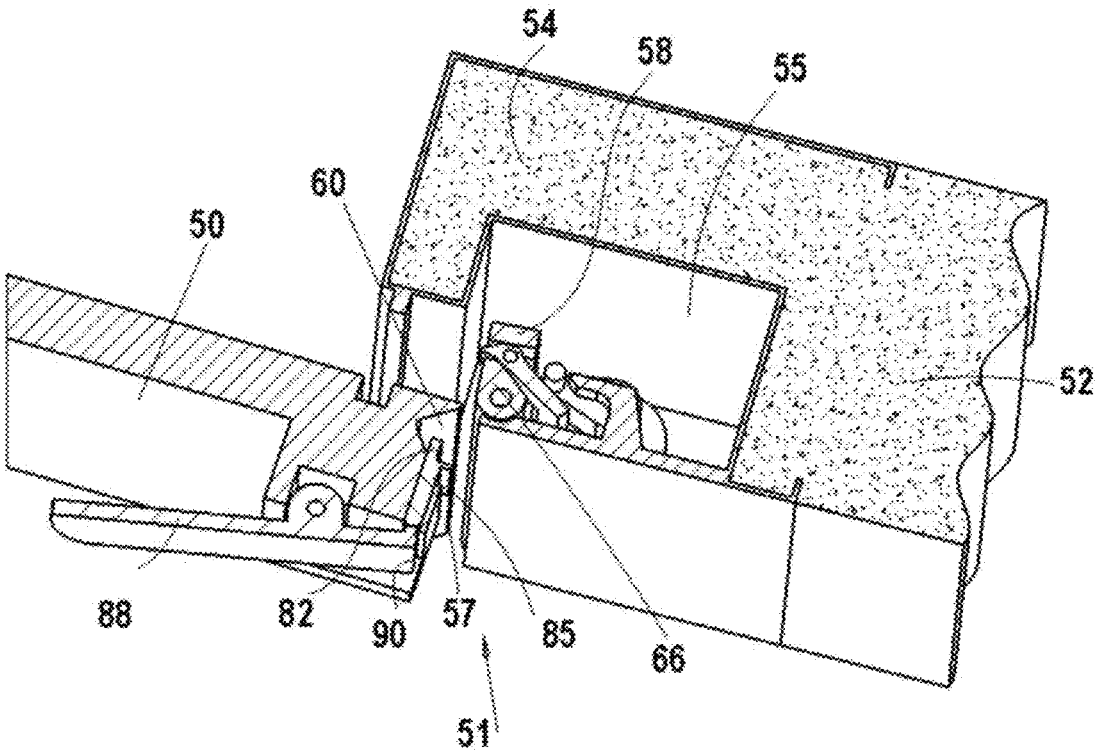
FIG. 2A is a perspective view of a panel having latch arrangement in accordance with another example of the presently disclosed subject matter.
Figure 2B:
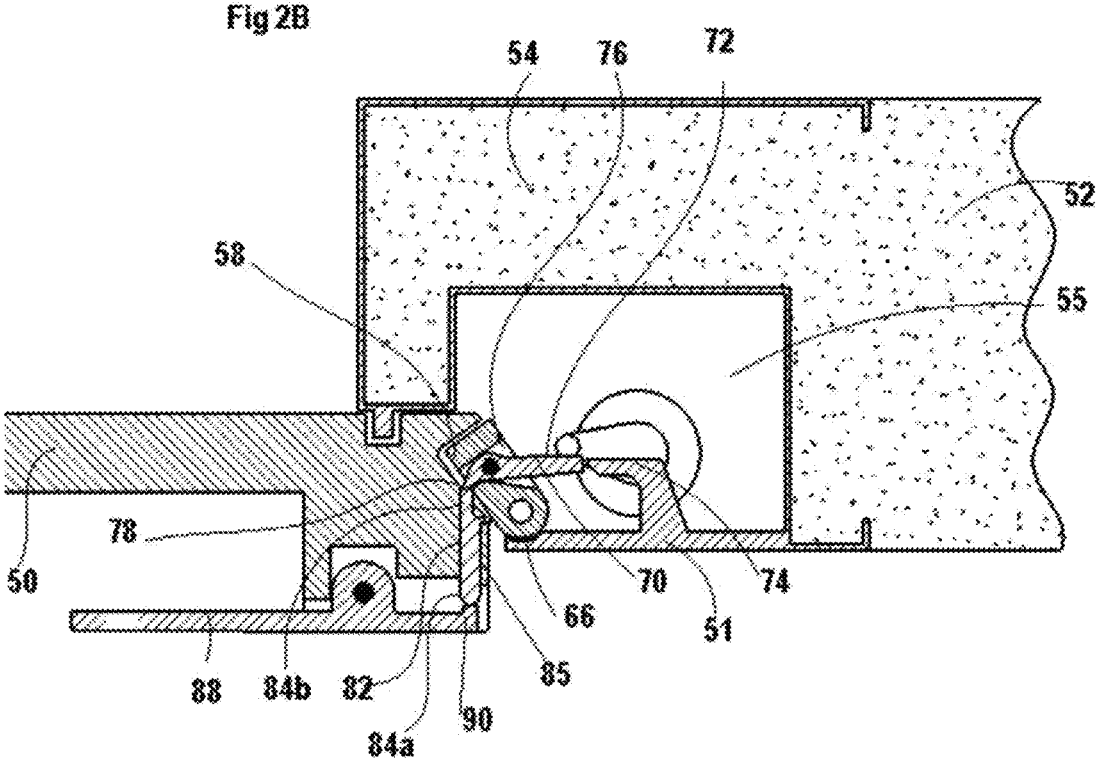
FIG. 2B is a top sectional view of the panel of FIG. 2A.
Figure 2C:
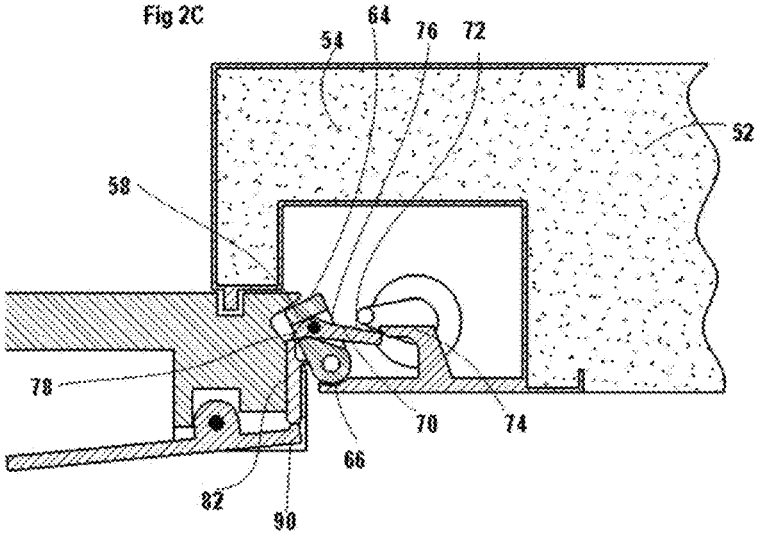
FIG. 2C is a top sectional view of the panel of FIG. 2A in a locked position of the latch arrangement.
Figure 2D:
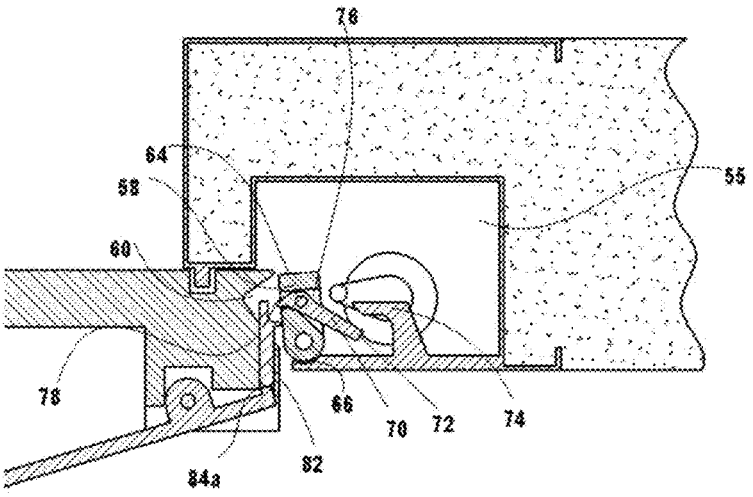
FIG. 2D is a top sectional view of the panel of FIG. 2A in an unlocked position of the latch arrangement.
Figure 2E:
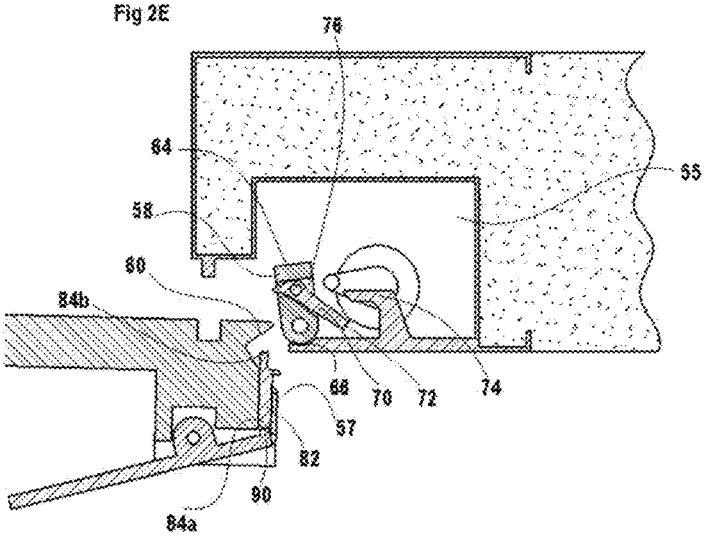
FIG. 2E is a top sectional view of the panel of FIG. 2A in an opened state thereof and in which the latch arrangement is in an unlocked position.

The latch arrangement 51, according to the present example, includes a locking element 58 pivotally mounted on the frame element 52 and displaceable between a locked position, as shown in FIGS. 2B and 2C, and an unlocked position shown in FIGS. 2A, 2D and 2E.

The locking element 58, can include a first end 64 configured to engage a depression 60 defined on the frame facing portion 57 of the door panel 50, and a second end 66 affixed to the frame element 52. In order to allow pivot of the locking element 58 about the second end 66, the latter has a rounded shape, and is mounted on a corresponding seat defined on the frame element 52.

According to an example, as shown in FIG. 2B, in the locked position, the locking element 58 is pivoted towards the panel 50 and away from the housing 55 and is disposed at an oblique angle with respect to the panel 50. The depression 60 on the frame facing portion 57, according to this example, is defined as a sloped cutaway which presents an angled surface with respect to the frame facing portion 57. The angle of the sloped cutaway depression 60 corresponds to the angle of the locking element 58 with respect to the panel 50, when the locking element 58 is in the locked position. This way, when the door panel 50 is in the closed state thereof and the locking element is pivoted to the locked position, the first end 64 of the locking element 58 is engaged with the cutaway depression 60, locking thereby the panel 50 to the frame element 52. It should be noted that the term "cutaway" is used herein as descriptive of the final form of depression 60, without in any way limiting the manufacturing technique used to produce the configuration, which does not necessarily include "cutting".

When the locking element 58 is pivoted away from the cutaway depression 60, the first end 64 of the locking element 58 is disengaged from the cutaway depression 60 on the panel 50, such that the latter is unlocked and can freely rotate to the opened state thereof, as shown in FIGS. 2D and 2E.

It is appreciated that the locking element 58 can extend along the entire or the majority of the length of the frame element, such that in the locked position it is engaged with the cutaway depression 60 which can also be defined along the entire or the majority of the length of the frame facing portion 57.

The latch arrangement 51 according to the present example further includes a deadlock element, here illustrated as a stop latch 70 selectively deployable to secure the locking element 58 in the locked position.

The stop latch 70 is pivotally mounted on the locking element 58 and is configured to secure the locking element 58 in the locked position. For example, the stop latch 70 can include a tail portion 72 extending into the housing 55 and configured to selectively engage an abutment feature 74 defined on the frame element 52. The stop latch 70 further includes a head tip 78 defined on an end of the stop latch 70, opposing the tail portion 72 and extending towards the frame facing portion 57.

The stop latch 70 is configured to pivot between a secured position, in which the locking element 58 is secured in the locked position thereof, and a released position in which the locking element 58 is free to pivot towards the housing 55 disengaging thereby the cutaway depression 60 of the panel 50.

In the secured position, shown in FIG. 2B, the tail portion 72 is engaged with the abutment feature 74 such that pivoting of the locking element 58 towards the housing is precluded, and the latter is maintained in the locked position thereof. In the released position, on the other hand, the stop latch 70 is slightly pivoted such that the tail portion 72 is disengaged from the abutment feature 74 such that the displacement of the locking element 58 away from the depression 60 to the unlocked position is no longer precluded.

According to an example, the stop latch 70 is mounted in a channel 76 defined along the width of the locking element 58, such that the stop latch can extend between the abutment feature 74 inside the housing 55 and the frame facing portion 57. The width of the channel 76 is slightly larger than the width of the stop latch 70 in such a way that the latter can pivot inside the channel 76. It is appreciated that the maximum pivoting angle of the stop latch 70 can be thus determined by the width of the channel 76.

This way, pivoting of the stop latch 70 to the released position thereof can be carried out by sidewardly pushing the head tip 78, disengaging thereby the tail portion 72 from the abutment feature 74 inside the housing 55.

The latch arrangement 51 further includes an actuating mechanism 80 configured to displace the locking element 58 to the unlocked position. According to the illustrated example the actuating mechanism 80 is further configured to pivot the stop latch 70 to the released position thereof such that the locking element 58 is unsecured and can be pivoted to the unlocked position.

The actuating mechanism 80 includes an actuating member 82 slidably mounted on the panel, for example inside a groove 85 defined in close proximity to the frame facing portion 57 and extending transversely with respect to the panel 50. The actuating member 82 includes a first end 84*a* facing an outer surface of the panel 50 and a second end 84*b* facing the head tip 78.

The actuating mechanism 80 further includes a manually operable handle 88 pivotally mounted on the panel 50, such that when a first end thereof is pivoted away from the panel 50, a second end 90 thereof is pushed towards the panel, as shown in FIG. 2D. The second end 90 of the handle 88 is configured to engage the first end 84*a* of the actuating member 82.

This way, when the handle 88 is pivoted away from the panel 50 the actuating member 82 is pushed by the second end 90 of the handle 88 and is urged to slide and to push thereby the head tip 78 of the stop latch 70. As a result, the stop latch 70 pivots to the released position thereof such that the tail portion 72 disengages the abutment feature 74 inside the housing 55, and the locking element 58 is free to pivot away from the depression 60.

As explained hereinabove, the channel 76 in which the stop latch 70 is mounted is so configured to allow a predetermined pivoting angle, such that when the stop latch 70 is pivoted to the maximum pivoting angle, the tail portion 72 of the stop latch 70 abuts the inner wall of the channel 76. Accordingly, further displacement of the actuating member 82 causes the second end 84*b* thereof to further push the head tip 78 of the stop latch 70 which can no longer pivot, thus causing displacement of the locking element 58 in which the stop latch 70 is mounted away from the depression 60.

This way, a single pivoting motion of the handle 88 such that the first end thereof is pulled away from the panel 50, shifts the stop latch 70 to the released position thereof, immediately following by pivoting of the locking element 58 to the unlocked position.

As shown in FIG. 2E, according to the illustrated example, the handle 88 is so mounted on the panel 50, such that pivoting thereof towards an opening direction of the panel causes the actuating member 82 to displace the stop latch 70 to the released position thereof, and the locking element 58 to the unlocked position thereof. This way, when it is desired to unlock and open the door panel 50 a single motion in one direction is required.

It is appreciated that the locking element 58 can include a return mechanism (not shown) configured to urge the locking element 58 away from the housing 55 to the locked position. Similarly, the stop latch 70 can be biased to normally be disposed in the secure positon thereof.

FIGS. 3A through 4B show a door or a window having latch arrangement 101 according to another example, configured for fastening a panel 100 to the frame element 102. As in the previous example, the panel is a panel of a hinged door and is configured to abut, in the closed state thereof, against a shoulder portion 104 defined on the frame element 102, which includes a housing 105 for holding therein the latch arrangement 101. In addition the panel includes a handle 132, pivotally mounted in close proximity to the end thereof, and is configured to allow opening of the panel 100 as explained hereinafter in detail.

Figure 3A:
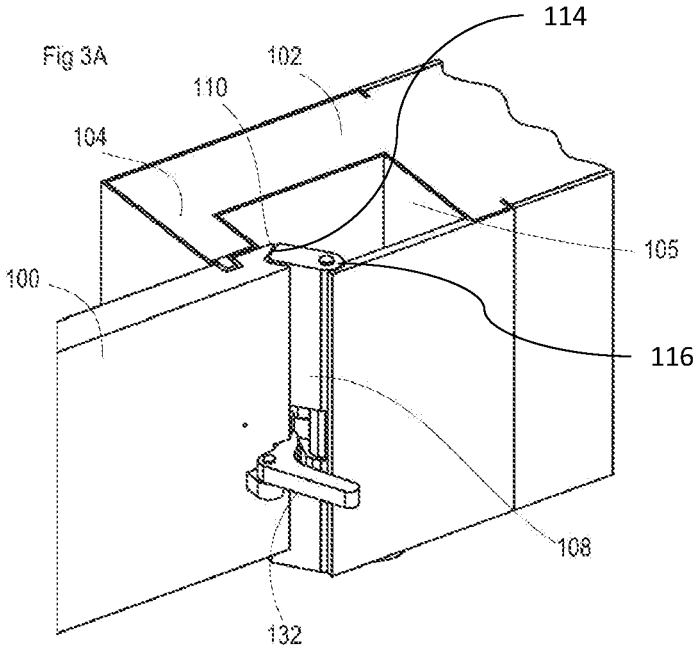
FIG. 3A is a perspective view of a panel having latch arrangement in accordance with another example of the presently disclosed subject matter.
Figure 3B:
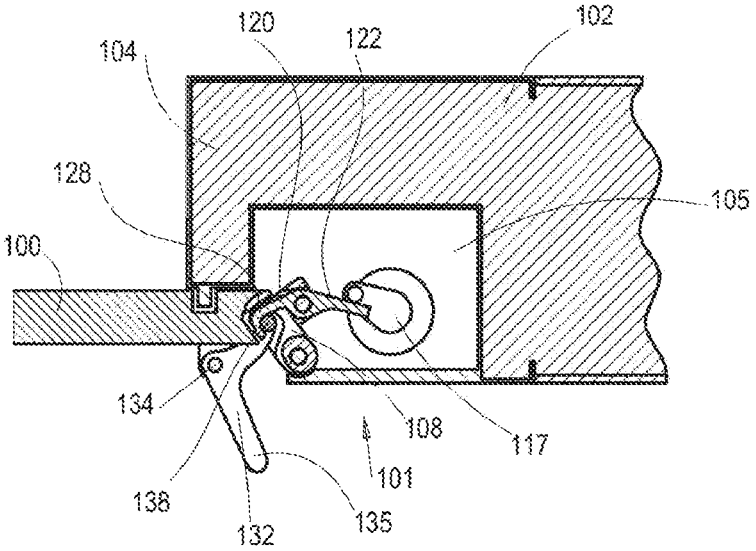
FIG. 3B is a top sectional view of the panel of FIG. 3A.
Figure 3C:
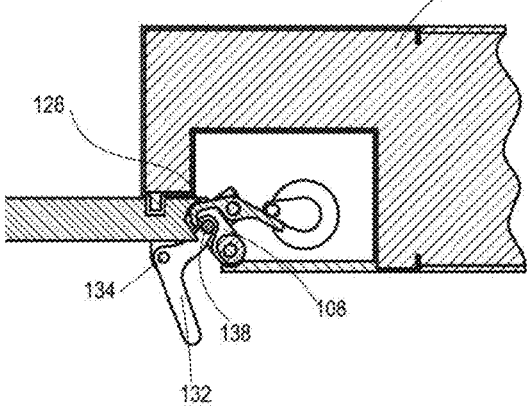
FIG. 3C is a top sectional view of the panel of FIG. 3A in a locked position of the latch arrangement.
Figure 3D:
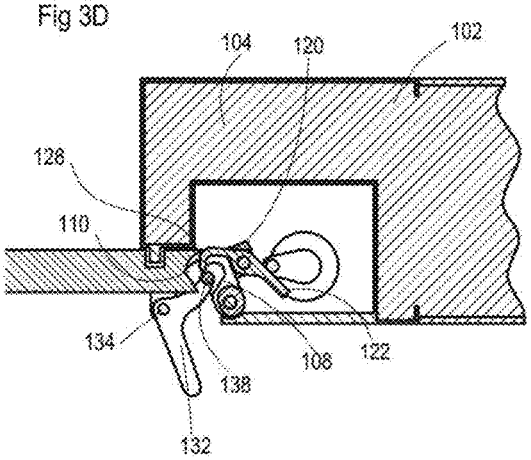
FIG. 3D is a top sectional view of the panel of FIG. 3A in an unlocked position of the latch arrangement.
Figure 3E:
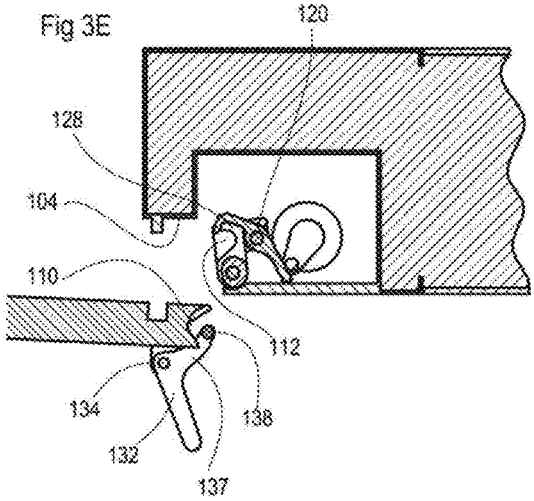
FIG. 3E is a top sectional view of the panel of FIG. 3A in an opened state thereof and in which the latch arrangement is in an unlocked position.

As in the previous example, the latch arrangement 101 includes a locking element 108 pivotally mounted on the frame element 102 and is displaceable between a locked position, as shown in FIG. 3B, and an unlocked position shown in FIGS. 3D, and 3E. In addition, as in the previous example, the latch arrangement 101 includes a stop latch 120 selectively deployable to secure the locking element 108 in the locked position.

According to the present example however, actuating the locking element 108 and the stop latch 120 can be carried out either by a manual actuator 137 pivotally mounted on the door panel 100, or by a rotating actuator 117 mounted inside the housing 105. In addition, it should be noted that according to the present example, the stop latch 120 is configured to secure the locking element 108 by engaging a catch member on the manual actuator 137, which is mounted to the panel 100. This is as opposed to the previous example, in which the stop latch 70 is configured to secure the locking element 58 by engaging an abutment feature mounted on the frame element 12.

It will be appreciated that the rotating actuator 117 can be replaced with a liner actuator configured to pivot the stop latch 120 and the locking element 108.

A detailed explanation of the present example is followed with reference to FIGS. 3B to 3E. The locking element 108 includes a first end 114 configured to engage a depression 110 defined on the frame facing portion 107 of the door panel 100, and a second end 116 affixed to the frame element 102. As shown in FIG. 3B, in the locked position, the locking element 108 is pivoted towards the panel 100 and is disposed at an oblique angle with respect to the panel 100. This way, in the locked position the first end 114 of the locking element 108 is engaged with the cutaway depression 110, locking thereby the panel 100 to the frame element 102, and in the unlocked position the locking element 108 is pivoted away from the cutaway depression 110, such that the panel 100 is unlocked and can freely rotate to the opened state thereof, as shown in FIG. 3E.

The stop latch 120 according to the present example is pivotally mounted on the locking element 108 and includes a tail portion 122 extending into the housing 105 and configured to engage the rotating actuator 117 mounted inside the housing 105. In addition the locking element 108 includes a hook 128 defined on an end of the stop latch 120 opposing the tail portion 122 and extending towards the frame facing portion 107.

The hook 128 is configured to engage a catch member 138 defined on the manual actuator 137 of the panel 100, such that the locking element 108 is secured in the locked position thereof.

Thus, the stop latch 120 is configured to pivot between a secured position, in which the locking element 108 is secured in the locked position thereof by the engagement of the hook 128 with the catch member 138, and a released position in which the locking element 108 is free to pivot towards the housing 105 disengaging thereby the cutaway depression 110 of the panel 100.

As mentioned above, the latch arrangement 101 according to the present example includes rotating actuator 117 mounted inside the housing 105. The rotating actuator 117 is configured to selectively rotate in a first and a second direction in a motion parallel to the pivoting motion of the stop latch 120, while engaging the tail portion 122 of the stop latch 120.

As shown in FIGS. 3C and 3D, when the rotating actuator 117 is rotated in a first direction, the rotational motion thereof urges the tail portion 122 of the stop latch 120 to pivot until the hook 128 on the other end of the stop latch 120 disengages the catch member 138 on the manual actuator 137, and the stop latch 120 is displaced to the released position.

The pivoting angle of the stop latch 120 can be limited by engagement with the locking element 108, such that further rotation of the rotating actuator 117 in the first direction urges the locking element 108 to pivot away from the depression 110 to the unlocked position thereof, as shown in FIG. 3D.

With reference to FIG. 3E, as the locking element 108 is pivoted away from the depression 110 and completely disengaged therefrom, the door panel 100 can be pulled by the handle 132 to the opened state thereof.

The rotating actuator 117 can be rotated in a second direction, such that the tail portion 122 of the stop latch 120 can be pivoted back to the secured position and the locking element 108 is pivoted back to the locked positon. It is appreciated that the pivoting of the stop latch 120 and the locking element 108 back to the secured and locked position, respectively, can be carried out by a return mechanism, such as a spring (not shown), etc. Accordingly, the rotating actuator 117 is configured to oppose the force of such return mechanism when the rotating actuator 117 is rotated in the first direction. When the rotating actuator 117 is rotated in the first direction however, the stop latch 120 and the locking element 108 are urged back to the secured and locked position, respectively, by the forces of the return mechanism.

As indicted above, according to the present example actuating the locking element 108 and the stop latch 120 can be carried out by means of a manual actuator 137 pivotally mounted on the door panel 100. The manual actuator 137 can be integrally formed with a handle 132 including a grip 135 and the manual actuator 137. The handle 132 can be configured to pivot on the panel 100 about a pivoting point 134 defined between the grip 135 and a manual actuator 137. According to the present example, the manual actuator 137 is configured to engage a recess 112 defined on the locking element 108 in the locked position, as shown in FIG. 3B.

As noted above, according to the present example, the actuating mechanism for displacing the locking element between the locked and unlocked position includes a manual actuator 137 and a rotating actuator 117. It is appreciated that the manual actuator 137 and the rotating actuator 117 can operate independently from one another.

Figure 4A:
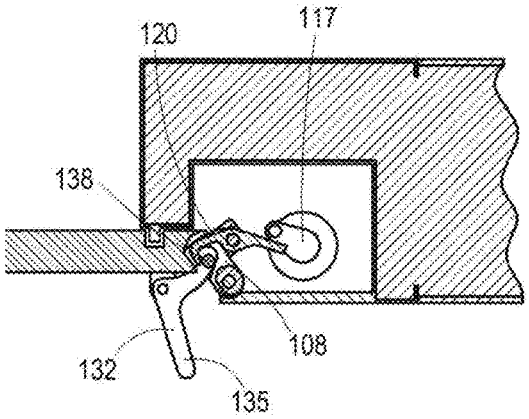
FIG. 4A is a top sectional view of the panel of FIG. 3A in another locked position of the latch arrangement.
Figure 4B:
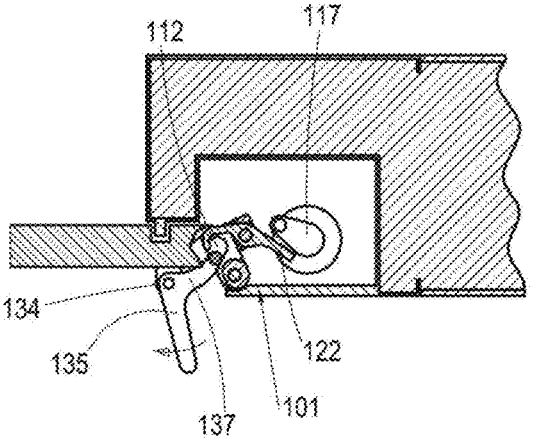
FIG. 4B is a top sectional view of the panel of FIG. 3A in a another unlocked position of the latch arrangement.

Attention is now directed to FIGS. 4A and 4B, in which the operation of the manual actuator 137 is illustrated. For manual opening of the door panel 100, the handle 132 can be pivoted towards an opening direction of the panel 100, causing thereby the manual actuator 137 to slide out of the recess 112 disengaging thereby the catch member 138 from the hook 128, such that the locking element 108 is no longer secured by the stop latch 120 and the catch member 138. As shown in FIG. 4B, further pivoting of the handle 132 towards an opening direction of the panel 100, causes the manual actuator 137 to push the locking element 108 away from the depression 110 to the unlocked position.

Attention is now directed to FIGS. 5A to 5E, a latch arrangement 151 can be implemented for fastening a panel 150 of a panic door to a frame element 152. As in the previous example, the panel 150 is a panel of a hinged door and is configured to abut, in the closed state thereof, against a shoulder portion 154 defined on the frame element 152 which includes a housing 155 for holding therein the latch arrangement 151. In addition the panel 150 includes a handle 162, pivotally mounted on the panel 150, and including a panic bar 164 horizontally extending along the panel 150. The panic door can be configured for an outdoor opening direction, such that pushing of the panic bar 164 in an opening direction of the door initiates the opening of the panel 150, as explained hereinafter.

Figure 5A:
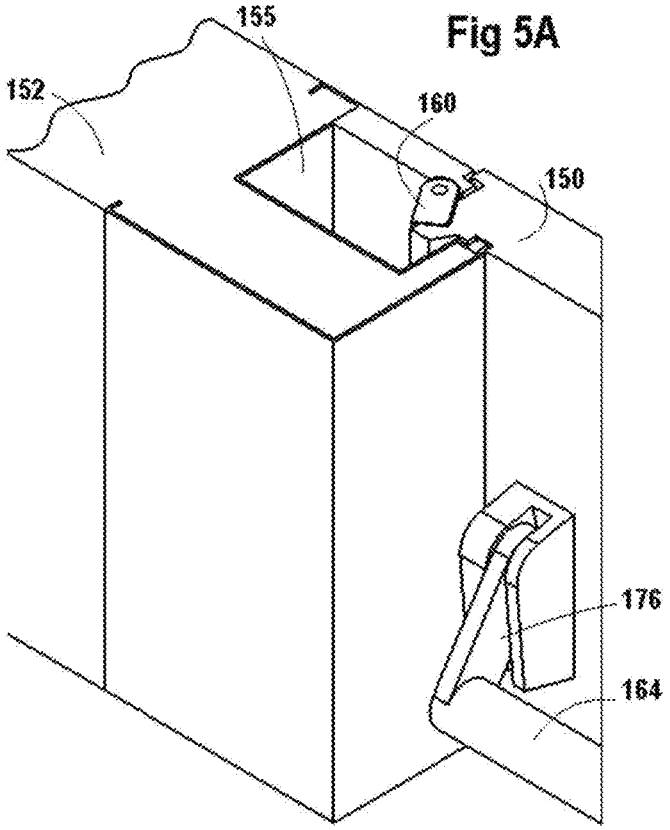
FIG. 5A is a perspective view of a panel having latch arrangement in accordance with another example of the presently disclosed subject matter.
Figure 5B:
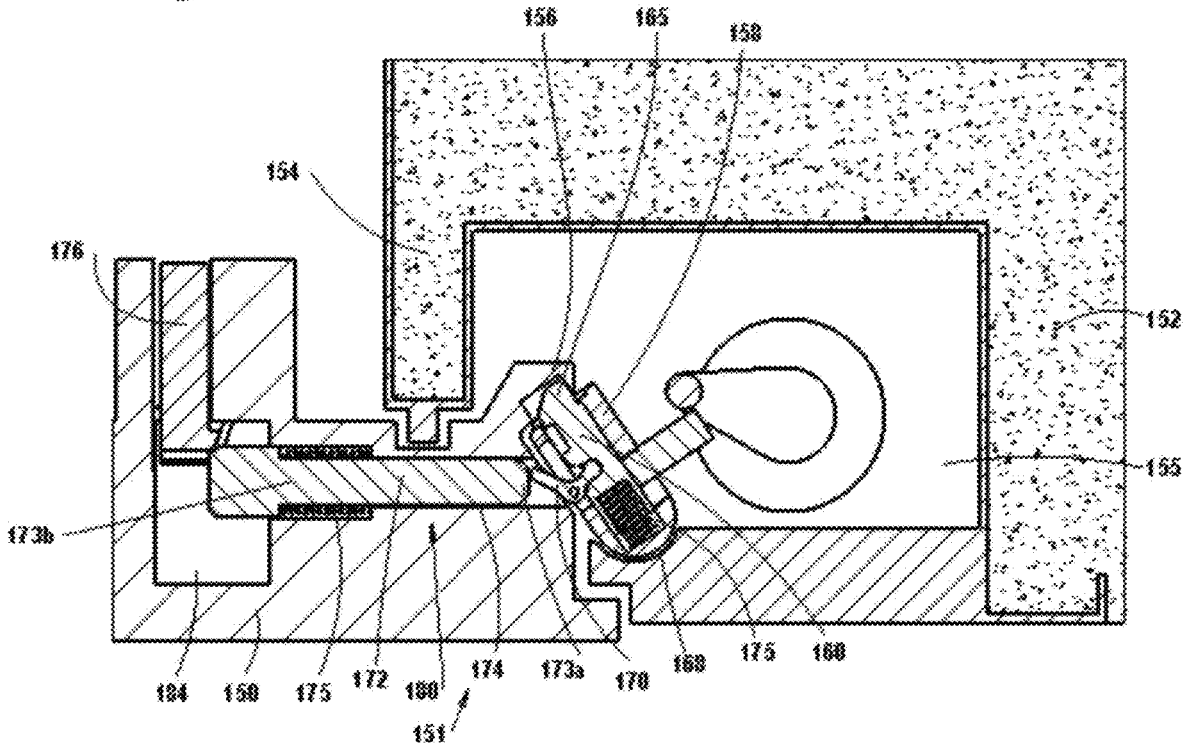
FIG. 5B is a top sectional view of the panel of FIG. 5A.
Figure 5C:
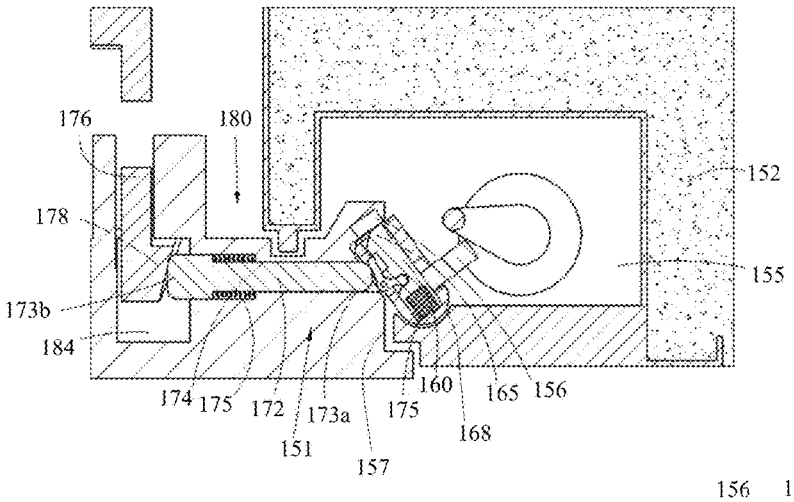
FIG. 5C is a top sectional view of the panel of FIG. 5A in a locked position of the latch arrangement.
Figure 5D:
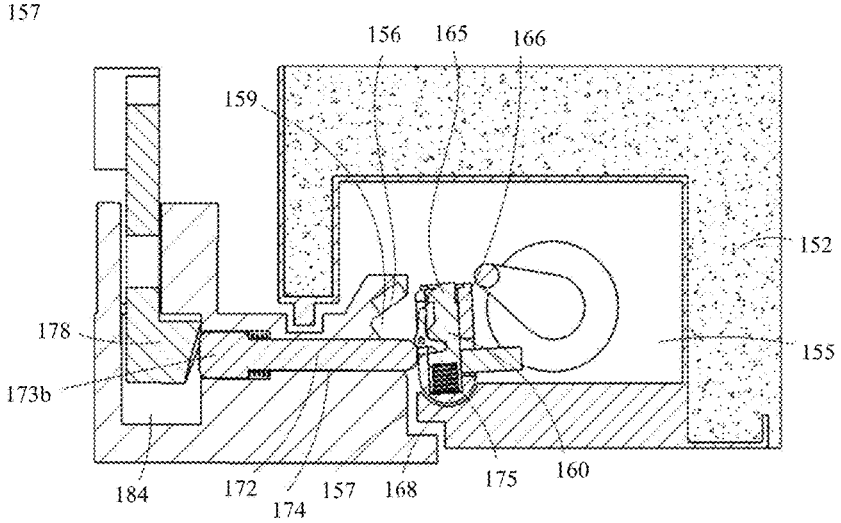
FIG. 5D is a top sectional view of the panel of FIG. 5A in an unlocked position of the latch arrangement.

As in the previous example, the latch arrangement 151 includes a locking element 158 pivotally mounted on the frame element 152 and displaceable between a locked position, as shown in FIG. 5B, and an unlocked position shown in FIGS. 5D, and 3E. In addition, as in the previous example, the latch arrangement 151 includes a stop latch 160 selectively deployable to secure the locking element 158 in the locked position.

According to the present example however, the stop latch 160 is slidably mounted inside the locking element 158 and is configured to slide between a secured position in which at least one of the stop latch 160 is engaged with an abutment feature in a form of a recess 156, and a released position in which at least one portion of the stop latch 160 is retracted away from the recess 156. Further, according to the present example the abutment feature i.e. the recess 156 is defined on the panel 150, as explained hereinafter, this is as opposed to the example of FIGS. 2A to 2E in which the abutment feature 74 is mounted on the frame element.

Figure 5E:
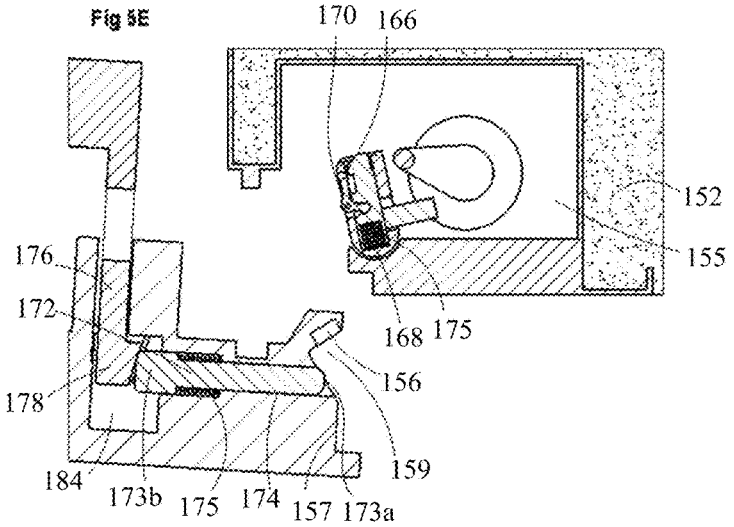
FIG. 5E is a top sectional view of the panel of FIG. 5A in an opened state thereof and in which the latch arrangement is in an unlocked position.

A detailed explanation of the present example is followed with reference to FIGS. 5B to 5E. The locking element 158 includes a first end 166 configured to engage a depression 159 defined on the frame facing portion 157 of the door panel 150, and a second end 168 affixed to the frame element 152. As shown in FIG. 5B, in the locked position, the locking element 158 is pivoted towards the panel 150 and is disposed at an oblique angle with respect to the panel 150. This way, in the locked position the first end 166 of the locking element 158 is engaged with the cutaway depression 159, locking thereby the panel 150 to the frame element 152, and in the unlocked position the locking element 158 is pivoted away from the cutaway depression 159, such that the panel 150 is unlocked and can freely rotate to the opened state thereof, as shown in FIG. 5E.

As indicated above, the stop latch 160 according to the present example is slidably mounted inside the locking element 158 and is configured to selectively slide between a secured position in which at least an engaging portion 165 thereof protrudes from the first end 166 of the locking element 158, and a released position in which the stop latch 160 is retracted inside the locking element 158.

The stop latch 160 can be spring biased by a spring member 175 mounted inside the locking element 158, and is configured to urge the stop latch 160 to the secured position, i.e. the engaging portion 165 protrudes from the first end 166.

Further, as indicated above, the recess 156 according to the present example is configured as a recess formed inside the cutaway depression 159, and configured to engage with the engaging portion 165 of the stop latch 160.

Thus, when the door panel 150 is at the closed state thereof, and the locking element 158 can be pivoted to the locked position in which the first end 166 thereof is engaged with the cutaway depression 159 on the door panel 150. At this position, the stop latch 160 can be shifted to the secured position thereof, in which the engaging portion 165 protrudes from the first end 166, such that it engages the recess 156 formed inside the cutaway depression 159 precluding thereby the pivoting of the locking element 158 away from the depression 159 to the unlocked position.

The locking element 158 further includes a pivot arm 170 pivotally mounted thereon and being coupled to the stop latch 160, such that when the pivot arm 170 is pivoted towards the locking element 158, the stop latch 160 is urged to slide towards the inside the locking element 158 to the released position, the purpose of the pivot arm 170 is explained herein below.

The latch arrangement 151 further includes an actuating mechanism 180, having an actuating member, here illustrated as an actuating pin 172 slidably disposed inside a groove 174 defined the panel 150 and having a first end terminating at the frame facing portion 157 of the door panel 150, and a second end terminating at a hollow portion 184 defined inside the panel 150. The groove 174 according to the illustrated example is so defined such that, when the panel 150 is in the closed state thereof, the groove 174 coaxially disposed with the pivot arm 170 of locking element 158.

The actuating pin 172 is thus configured to slide inside the groove 174 between the first and second ends of the groove 174, towards and away from the outer surface of the frame facing portion 157, such that the first end 173*a* thereof can selectively engage the pivot arm 170. As shown in FIG. 5B, the actuating pin 172 is disposed such that the second end 173*b* thereof is disposed inside the hollow portion 184, the purpose of which is explained hereinafter.

This way, as shown in FIG. 5C, when the actuating pin 172 is slid forwards and is engaged with the pivot arm 170 the latter pivots and causes the stop latch 160 to slide towards the inside the locking element 158 to the released position thereof, as shown in FIG. 5D.

The actuating pin 172 can be biased by a spring 175, such that is normally urged away from the outer surface of the frame facing portion 157. At this position, the pivot arm 170 is pivoted towards the first end of the groove 174.

According to an example, the actuating mechanism 180 can be manually operated by the handle 162 which, as noted above, includes a panic bar 164 pivotally mounted on the panel 150. The handle 162 can be displaceable between a first positon in which the locking element 158 is urged away from the depression 159 and a second position in which the locking element 158 is free to engage the depression 159.

For example, the handle 162 can include a pivoting mount 176, on which the panic bar 164 is mounted. The pivoting mount 176 is pivotally mounted on the door panel 150 and includes a sloped member 178 configured to pivot in and out of a hollow portion 184 formed inside the panel 150. The hollow portion 184 is defined such that the second end of the groove 174 is accessible through the hollow portion 184, and the second end 173*b* of the actuating pin 172 protrudes inside the hollow portion 184.

The sloped member 178 of the pivoting mount 176 includes a portion having varying thickness so defined thereon such that when the sloped member 178 is pivoted inside the hollow portion 184 the sloped portion faces the second end of the groove 174 and engages the second end 173*b* of the actuating pin 172, which as indicated above is disposed in the hollow portion 184.

This way, when the panic bar 164 is pushed to the first positon thereof, the pivoting mount 176 is pivoted and the sloped member 178 slides inside the hollow portion 184 such that the sloped member 178 engages the end of the actuating pin 172.

As a result, the sloped member 178 selectively urges the actuating pin 172 to slide inside the groove 174 towards the frame facing portion 157 pushing thereby the pivot arm 170 to pivot and displace the stop latch 160 to the release position. Further pushing of the panic bar 164 causes the sloped member 178 to further pivot into the hollow portion 184 and the actuating pin 172 to further slide inside the groove 174. At this position the further displacement of the pivot arm 170 in limited by the locking element 158, thus further displacement of the pivot arm 170 by the actuating pin 172 causes the locking element 158 to pivot away from the cutaway depression 159.

When the panic bar 164 is released to the second position of the handle, the spring 175 of the actuating pin 172 biases the actuating pin 172 such that it is retracted back toward the hollow portion 184, and the allowing the pivot arm 170 to pivot back and displace the stop latch 160 to the secured position in which the engaging portion 165 of the stop latch 160 engages the recess 156 formed inside the cutaway depression 159 precluding thereby the pivoting of the locking element 158 away from the depression 159 to the unlocked positon.

Turning now to FIGS. 19-23, there is shown an application of the invention to a locking mechanism which is believed to be inventive in its own right. Specifically, FIGS. 19-23 illustrate a latch arrangement, generally designated 900, in which a frame-mounted retractable locking element 902 is interposed between a panel 904 and a frame element 906 through a motion in a direction oblique to the plane of closure of the panel within the frame. In the non-limiting example illustrated here, locking element 902 is mounted to move through a linear sliding motion at an angle that is preferably between 30° and 60° to the plane of closure, and most preferably at about 45° (±5°) to the plane of closure. Non-linear motion of the locking element, such as a rotary motion or a more complex compound motion, may also be used so long as the relevant part of the motion for engaging and disengaging between the panel and frame is an obliquely directed motion as stated. Insertion of a locking element obliquely at such angles, together with suitably oriented pressure surfaces on both the panel and frame, provides highly effective locking of the panel, where forces acting to open the panel are converted to compression forces acting on the locking element.

In the preferred embodiment illustrated here, latch arrangement 900 provides for powered operation by a rotary actuator 908 mounted on frame element 906 and manual operation by a panel-mounted handle 910, and includes a deadlock mechanism which is released by each of these modes of operation. Specifically, locking element 902 here includes a pivotally-mounted stop-latch element 912 which has an engagement tooth 914 which is biased by a spring 916 to engage a complementary recess 918 in panel 904. This engagement provides deadlock functionality, obstructing displacement of locking element 902 from its locked position to an unlocked position.

Rotary actuator 908 includes an actuator body (not shown) which rotates a double cam assembly including a first cam 920 and a second cam 922 that are rigidly interconnected. First cam 920 is deployed to act on a tail portion 924 of stop-latch element 912. Second cam 922 is deployed to act on a frame 926 that is integrated with locking element 902. A spring 928 biases frame 926 and hence also locking element 902 to a locked position.

Figure 20B:
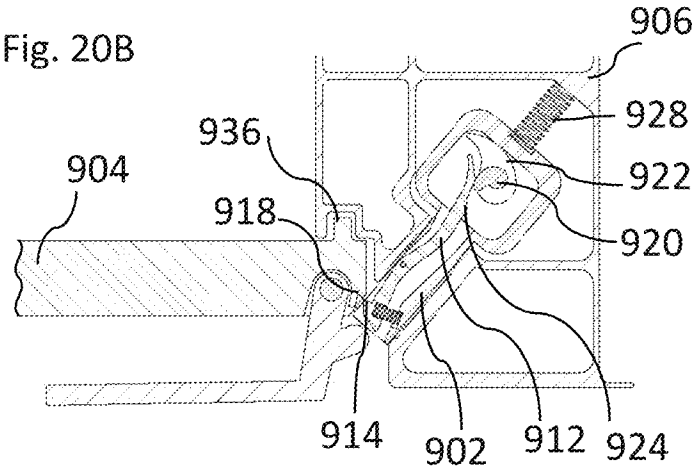
FIGS. 20A-20C are a series of views similar to FIG. 19 illustrating a sequence of operations for powered actuation of the latch arrangement.
Figure 20A:
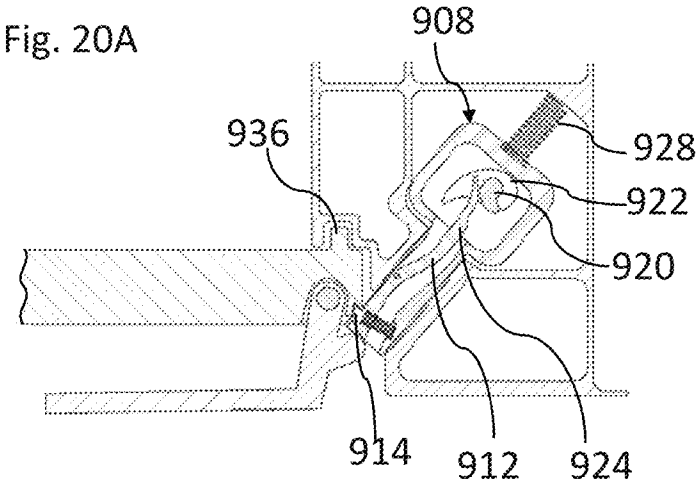
Figure 20C:
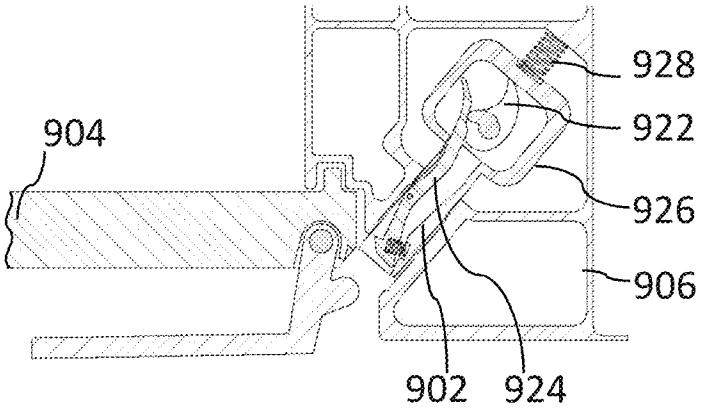

A sequence of operation for unlocking of the panel by rotary actuator 908 is illustrated in FIGS. 20A-20C. FIG. 20A illustrates the initial locked state, equivalent to FIG. 19. On operation of the rotary actuator 908, the double cam assembly begins to rotate, and first cam 920 bears on tail portion 924 of stop-latch element 912, causing it to rock about its pivot axis and disengage tooth 914 from recess 918 (FIG. 20B). Further rotation of the double cam assembly brings second cam 922 to bear on the inside of frame 926, thereby displacing locking element 902 to as to withdraw the locking element to an unlocked position (FIG. 20C) in which it no longer obstructs opening of the panel. Typically, after a predetermined period of time, the rotary actuator returns in the opposite direction (anticlockwise as shown) to its starting position, allowing spring 928 to return locking element 902 to its locking position, either relocking panel 904 in place or waiting for the panel to be pushed closed (causing temporary resilient retraction of the locking element against the spring) and then relocking.

Figure 21B:
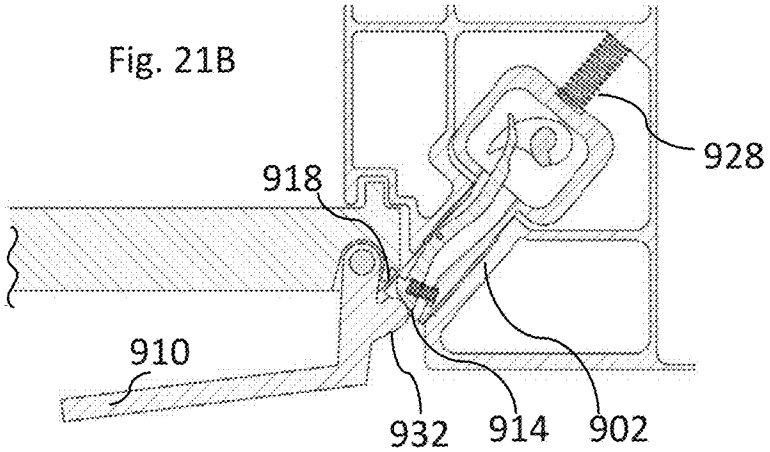
FIGS. 21A-21D are a series of views similar to FIG. 19 illustrating a sequence of operations for manual actuation of the latch arrangement.
Figure 21D:
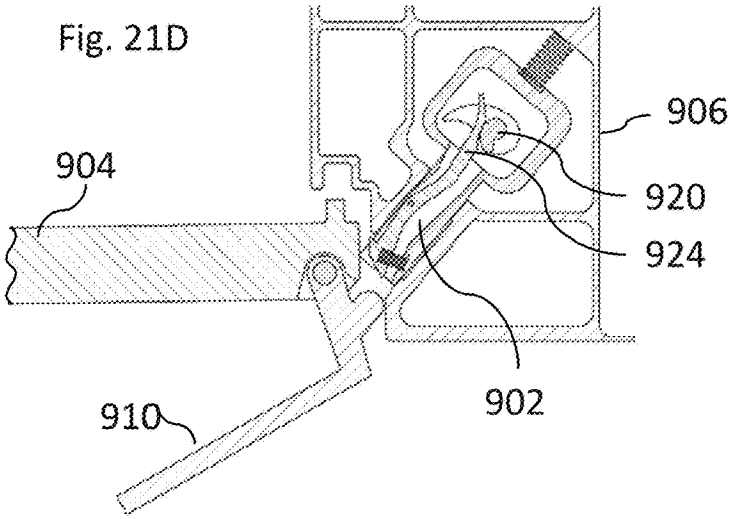
Figure 21A:
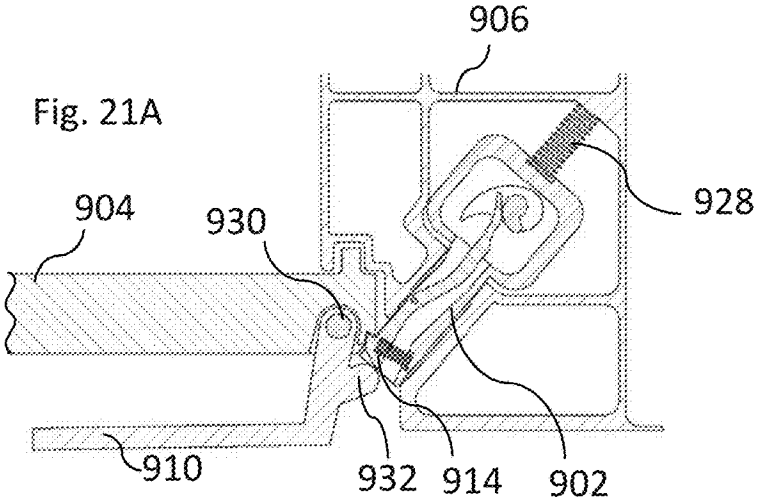
Figure 21C:
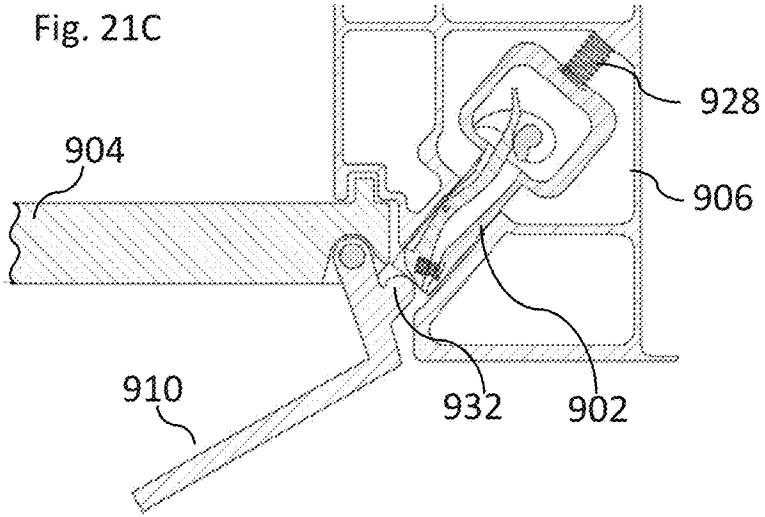

As an alternative to powered actuation, panel 904 can also be opened manually by use of manual handle 910 mounted on the panel. The sequence of manual opening is illustrated in FIGS. 21A-21D. On displacement of handle 910 by pivoting about a pivot axis 930, an actuating projection 932 is brought to bear against an inclined distal end of stop-latch element 912, thereby pivoting the stop-latch element until engagement tooth 914 clears complementary recess 918 (FIG. 21B). Further motion of the handle pushes locking element 902 to retract against the action of spring 928 to a position which allows panel 904 to be opened. Optionally, a curved profile of tail portion 924 of stop-latch element 912 is formed such that, during retraction of locking element 902, contact of tail portion 924 with first cam 920 rocks stop-latch element 912 sufficiently to avoid frictional rubbing of engagement tooth 914 with the walls of the channel within which locking element 902 is mounted. As the panel starts to move, locking element 902 is maintained in its retracted state by contact with the edge of the panel, until the panel has passed, at which point the locking element returns to its default locked position, ready to relock the door when closed.

Figure 22:
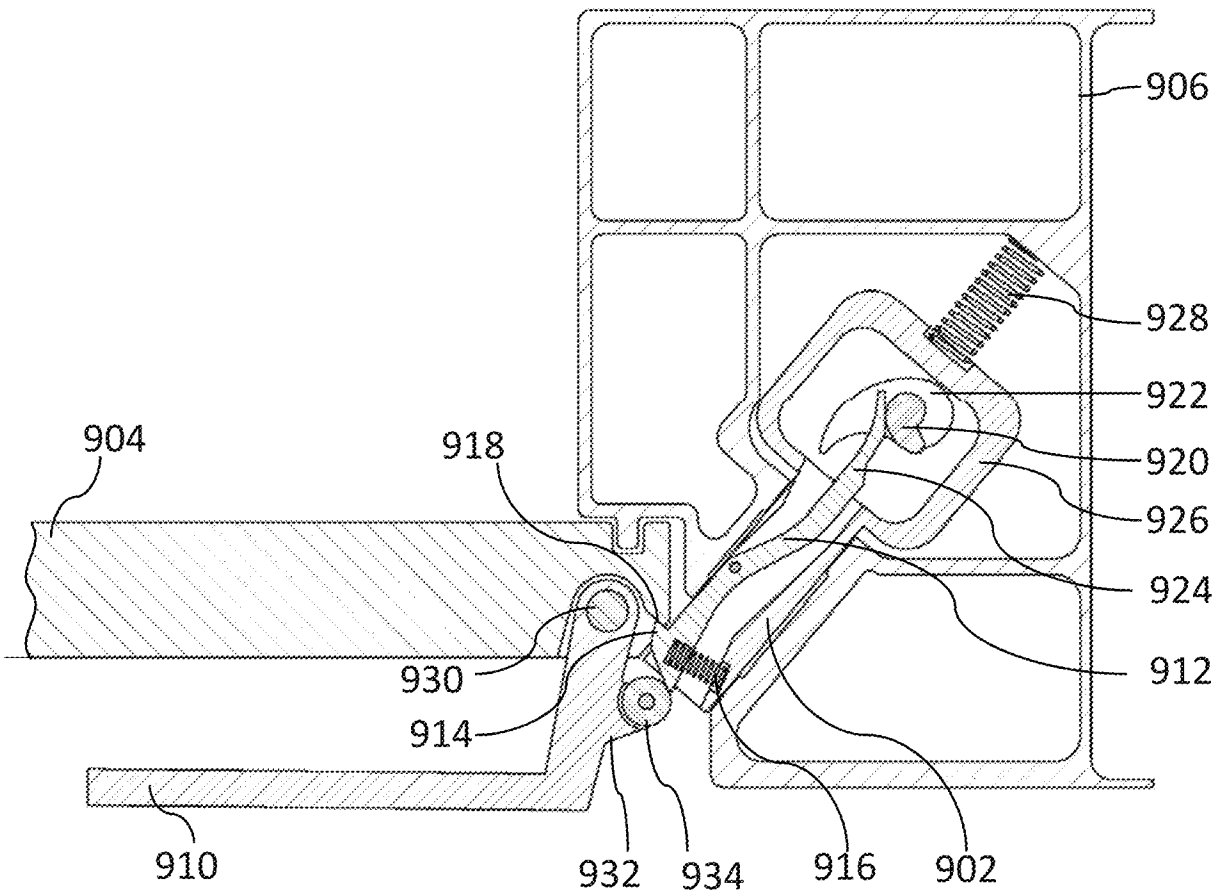
FIG. 22 is a view similar to FIG. 19 illustrating a variant implementation of the latch arrangement with addition of a friction-reducing roller element.

FIG. 22 shows a modification of latch arrangement 700 in which actuating projection 932 is provided with a roller element, such as roller bearing 934, to reduce frictional resistance between actuating projection 932 and stop-latch element 912.

Figure 23:
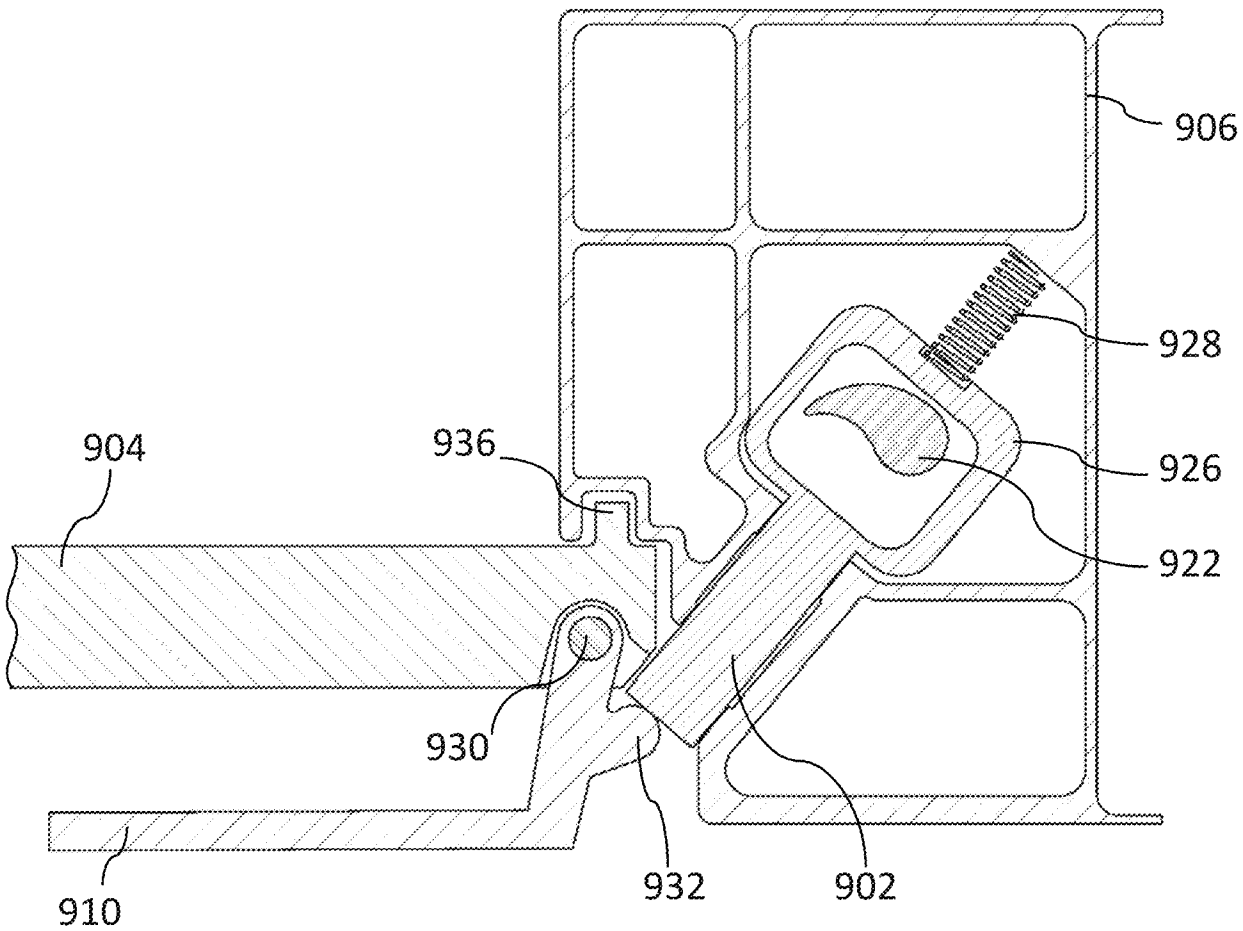
FIG. 23 is a view similar to FIG. 19 illustrating a simplified implementation of the latch arrangement.

FIG. 23 shows a simplified version of latch arrangement 700 without a deadlock mechanism. In this case, the structure of locking element 902 is simplified to a solid block, and only a single cam mechanism is used for powered actuation. The direction of motion of the locking element inherently makes it relatively difficult to displace by insertion of tools or flexible elements around the edge of the panel from the outside, and this protection is preferably further enhanced by the use of a male/female ridge-and-slot engagement 936, such that a deadlock mechanism may not in fact be required. In all other respects, the structure and function of the latch arrangement of FIG. 23 is the same as that of latch arrangement 700 detailed above.

The embodiment of FIGS. 19-23 may be implemented with either a localized bolt-like locking element, or with an elongated locking tongue which extends along a significant proportion of the corresponding dimension of the panel, for example, at least 10%, and in some cases a majority.

FIGS. 6A to 6E show a latch arrangement 201 configured for fastening a panel 200 of a sliding door to a frame element 202, this is as opposed to the previous example, in which the panel is a panel of a hinged door. Similar to the previous examples the latch arrangement 201 includes a locking element 210 pivotally mounted on the frame element 202 and an actuating mechanism including a manually operable handle 212 mounted on the panel 200 and being configured to interact with the locking element 210 to lock the panel to the frame element 202.

The frame element 202 includes a first side portion 204*a* coupled to a second side portion 204*b* and being spaced apart from the first side portion 204*a* defining thereby a housing 206 therebetween. The housing 206 is configured for receiving therein an end segment of the panel 200.

The frame element 202 further includes an abutting portion 208 transversely extending inside the housing 206 from the first side portion 204*a* defining an opening 205 between an edge thereof and the second side portion 204*b*. The opening 205 is configured to allow sliding of the end segment of the panel 200 therethrough into the housing 206.

According to this example, the panel 200 can include a depression having shoulder portion 209 protruding from the surface of the panel 200 towards the first side portion 204*a* of the frame element 202.

Figure 6A:
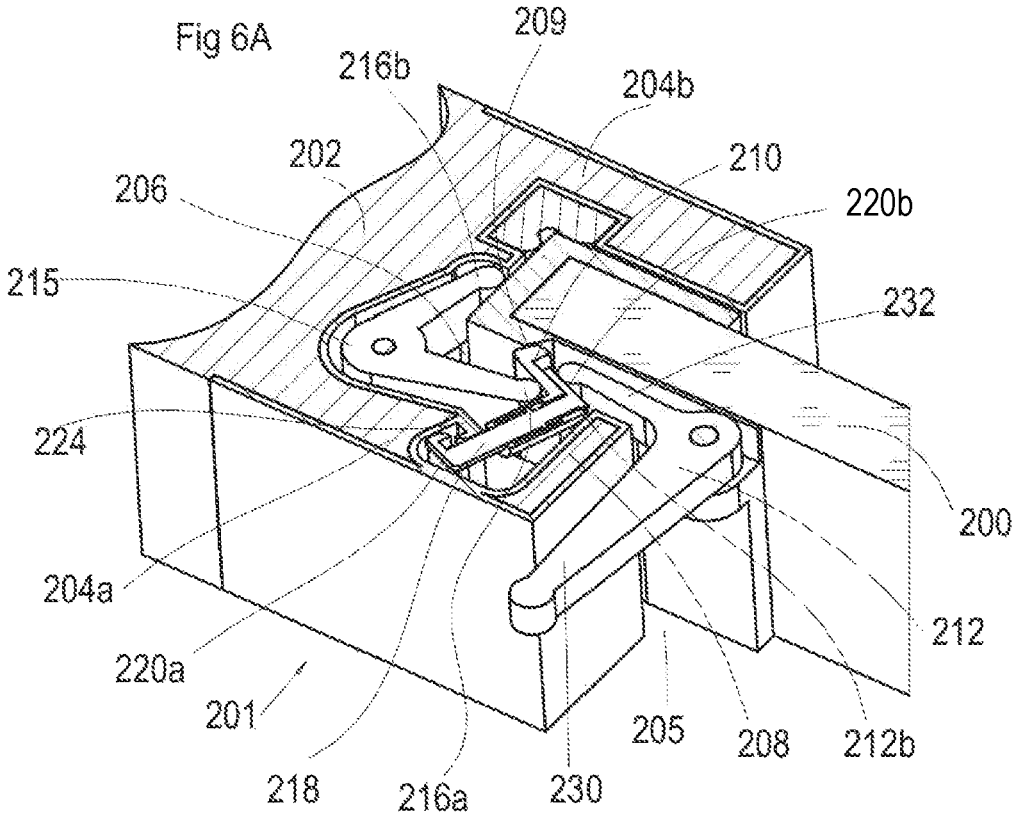
FIG. 6A is a perspective view of a panel having latch arrangement in accordance with yet another example of the presently disclosed subject matter.
Figure 6B:
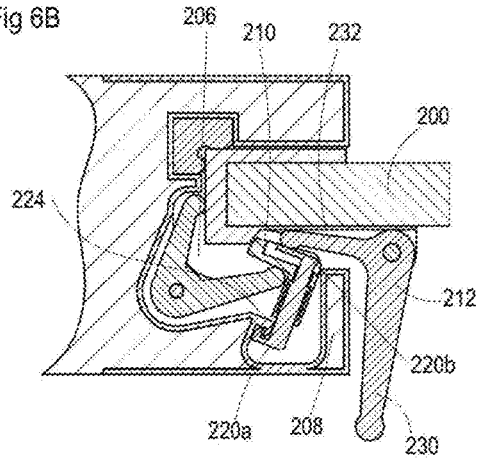
FIG. 6B is a top sectional view of the panel of FIG. 6A.
Figure 6C:
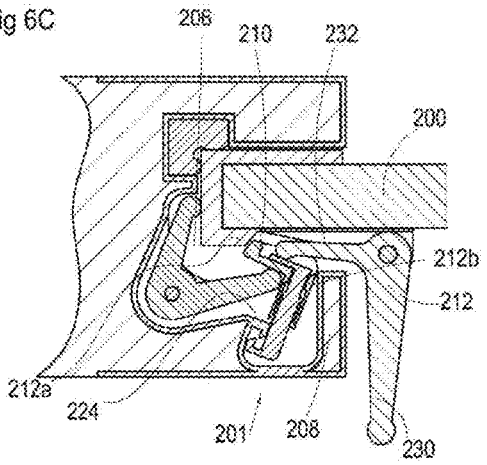
FIG. 6C is a top sectional view of the panel of FIG. 6A in a locked position of the latch arrangement.
Figure 6D:
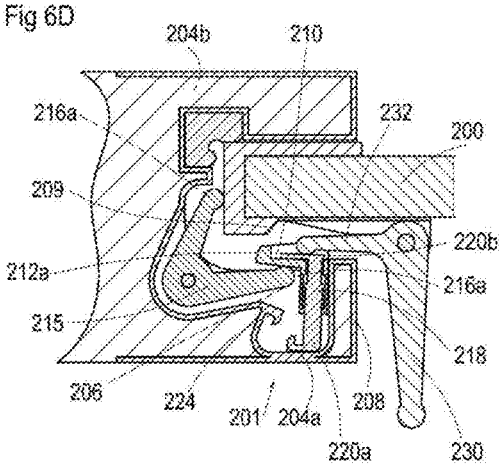
FIG. 6D is a top sectional view of the panel of FIG. 6A in an unlocked position of the latch arrangement.
Figure 6E:
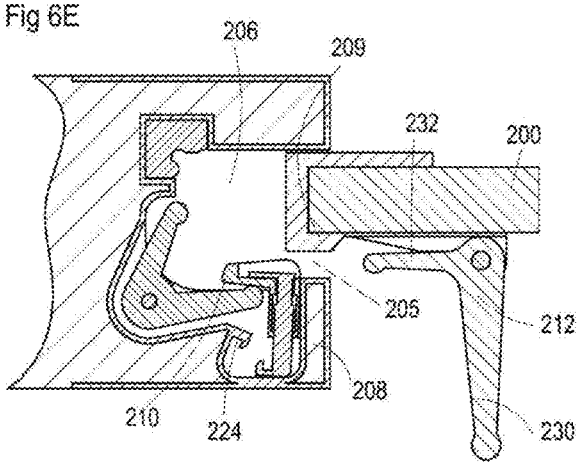
FIG. 6E is a top sectional view of the panel of FIG. 6A in an opened state thereof and in which the latch arrangement is in an unlocked position.

The locking element 210 include a first end 212*a* and a second end 212*b*, and is disposed in the housing 206 and displaceable between a locked position (FIGS. 6A and 6B) and an unlocked positon (FIGS. 6D and 6E). In the locked position the first end 212*a* of the locking element 210 is engaged with shoulder portion 209 of the panel 200, while the second end 212*b* is engaged with the abutting portion 208 of the frame element 202 precluding thereby the sliding of the panel 200 out of the housing 206. In the unlocked position the locking element 210 is pivoted such that the first end 212*a* of the locking element 210 is disengaged from the shoulder portion 209 of the panel 200 such the panel 200 is free to be slid away from the frame element 202 to the open state thereof.

According to an example, the locking element 210 in the locked position is extended at an oblique angle with respect to the panel 200 such that the first end 212*a* is engaged with the shoulder portion 209 which can also be formed with a corresponding angle. This way, in the locked position of the locking element 210 the displacement of the panel 200 towards an opening direction of the panel is opposed by compressive forces exerted between the locking element 208 and the butting portion 208 of the frame element 202.

The latch arrangement 201 can further include a positive lock member 215 pivotally mounted inside the housing 208 and having a first arm 216*a* and a second arm 216*b*. The first arm 216*a* is configured to engage an edge of the panel 200 when in the closed state, and the second arm 216*b* is configured to engage a surface of the locking element 210. The positive lock member 215 is configured such the when the panel 200 is slid into the housing 208 to the closed state thereof, the edge of the panel 200 engages the first arm 216*a* and pushes it in a direction parallel to the closing direction of the panel 200. As a result, the positive lock member 215 is pivoted and the second arm 216*b* urges the locking element 210 to the locked position, i.e. the first end 212*a* is engaged with the shoulder portion 209. Thus, the positive lock member 215 allows an autonomous displacement of the locking element 210 to the locked position thereof upon closing of the door panel 200.

It is appreciated that the positive lock member 215 is an optional element, and the latch arrangement 201 according to other examples include a return mechanism configured to urge the locking element 210 to the locked position thereof.

As in the previous example, the latch arrangement 201 further includes a stop latch 218 selectively deployable to secure the locking element 210 in the locked position. The stop latch 218 is slidably mounted inside the locking element 210 and include a hook portion 220*a* defined on one end thereof and an engaging portion 220*b* defined on an opposing end thereof. The stop latch 218 is configured to slide inside the locking element 210 while the hook portion 220*a* is disposed on one side of the locking element 210 while the engaging portion 220*b* is disposed on a second side of the locking element 210. The stop latch 218 is configured to slide between a secured position in which the hook portion 220*a* is engaged with an abutment feature in a form of a catch member 224 on the frame element 202, and a released position in which the hook portion 220*a* is disengaged from the catch member 224.

The hook portion 220*a* of the stop latch 218 and the catch member 224 on the frame element 202 are configured to be engaged to one another when the locking element 210 is pivoted to the locked position thereof. That is to say, catch member 224 on the frame element 202 is disposed in parallel with the sliding axis of the stop latch 218, when the locking element 210 is in the locked position. This way, at this position, as shown in FIGS. 6B and 6C, the stop latch 218 can be selectively slid between a secured position in which the hook portion 220*a* is engaged with the catch member 224 on the frame element 202, precluding thereby the pivoting of the locking element 210 to the unlocked position thereof, and a released position in which the hook portion 220*a* is disengaged from the catch member 224, and the locking element 210 is free to pivot to the unlocked position thereof.

Since the stop latch 218 is mounted on the locking element 210, when the latter is pivoted to the unlocked position thereof, the catch member 224 is no longer parallel to the sliding axis of the stop latch 218 and the hook portion 220*a* can no longer be engaged with the catch member 224, as shown in FIG. 6D. At this position, the panel 200 can be slid out of the housing 206 as shown in FIG. 6F.

The stop latch 218 can be biased by a spring member 222 mounted inside the locking element 210 urging the stop latch 218 to the secured position thereof.

The latch arrangement 201 further includes an actuating mechanism including a manually operable handle 212 mounted on the panel 200 and being configured to interact with the locking element 210 to lock the panel to the frame element 202.

According to the illustrated example, the handle 212 is pivotally mounted on the panel 200 and includes a grip 230 and an actuating member 232. The actuating member 232 is disposed in close proximity with the surface of the panel 200, while the grip 230 protrudes away from the surface of the panel 200 such that it can be griped.

The handle 212 is mounted such that when the edge of the panel 200 is inserted inside the housing 206, the actuating member 232 is inserted therewith and is configured to engage the engaging portion 220*b* of the stop latch 218.

The handle 212 can be pivoted between a first position in which the actuating member 232 is pivoted towards the surface of the panel 200 and a second position in which the actuating member 232 is pivoted away the surface of the panel 200. As shown in FIG. 6C, when the panel is in the closed state thereof pivoting the handle 212 to the second position causes the actuating member 232 to engage the engaging portion 220*b* of the stop latch 218, and to urge the stop latch 218 to slide to the released position thereof. At this position the hook portion 220*a* is disengaged from the catch member 224, and the locking element 210 is free to pivot to the unlocked position thereof.

As can be seen in FIG. 6C, the sliding of the stop latch 218 inside the locking element 210 is limited by the engaging portion 220*b* abutting against the locking element 210. Thus further pivoting of the handle 212 causes the engaging portion 220*b* to urge the locking element 210 to pivot to the unlocked position thereof, as shown in FIG. 6D.

This way, a single motion of pivoting the handle 212 such that the actuating member 232 thereof is pulled away from the panel 200, shifts the stop latch 218 to the released position thereof, immediately following by pivoting of the locking element 210 to the unlocked position.

As shown in FIG. 6E, according to the illustrated example, the handle 212 is so mounted on the panel 200, such that pivoting of the grip 230 towards an opening direction of the panel 200 causes the actuating member 232 to displace the stop latch 218 to the released position thereof, and the locking element 210 to the unlocked position thereof. This way, when it is desired to unlock and open the door panel 200 a single motion of pulling the grip 230 in one direction is required.

To the extent that the appended claims have been drafted without multiple dependencies, this has been done only to accommodate formal requirements in jurisdictions which do not allow such multiple dependencies. It should be noted that all possible combinations of features which would be implied by rendering the claims multiply dependent are explicitly envisaged and should be considered part of the invention.

It will be appreciated that the above descriptions are intended only to serve as examples, and that many other embodiments are possible within the scope of the present invention as defined in the appended claims.

The invention claimed is:

1. A latch arrangement for locking a panel of a door or a window to a frame element, the latch arrangement comprising:

a locking element mounted on the frame element and rotatable between a locked position, in which said locking element is engaged with the panel, thereby locking the panel to the frame element, and an unlocked position, in which said locking element is disengaged from the panel, thereby unlocking the panel from the frame element;

a stop latch deployed to assume a secured position, in which said stop latch mechanically obstructs rotation of said locking element to prevent rotation of said locking element to said unlocked position, said stop latch being displaceable to a released position, in which said locking element is free to rotate to said unlocked position; and an actuating mechanism configured to selectively displace said stop latch to said released position and to rotate said locking element to said unlocked position, wherein said actuating mechanism is mounted on the panel.

2. The latch arrangement according to claim 1, wherein said actuating mechanism comprises a manually displaceable handle displaceably mounted on the panel, and wherein the actuating mechanism is configured such that motion of said handle performs sequential displacement of said stop latch to said released position followed by rotation of said locking element out of engagement with the panel.

3. The latch arrangement according to claim 2, wherein said handle is pivotable towards an opening direction of the panel.

4. The latch arrangement according to claim 2, wherein said actuating mechanism includes an actuating member displaceably mounted on the panel and configured to selectively move towards said locking element, whereby said locking element is rotated to said unlocked position.

5. The latch arrangement according to claim 4, wherein said handle includes a portion engaging said actuating member, and wherein said handle is configured such that, when said handle is displaced to a first position, said actuating member is displaced towards said locking element whereby said locking element is rotated to said unlocked position.

6. The latch arrangement according to claim 5, wherein said handle includes a panic bar displaceable towards the panel and a linkage actuated by movement of said panic bar, said linkage being configured to engage said actuating member and urge said actuating member to move towards said locking element.

7. The latch arrangement according to claim 4, wherein said actuating member comprises a roller element deployed to bear on said locking element.

8. The latch arrangement according to claim 1, wherein said stop latch is pivotally connected to said locking element and is configured to pivot between said secured position and said released position.

9. The latch arrangement according to claim 1, wherein, when said locking element is in said locked position, said locking element engages a pressure surface of the panel oriented at an inclination to a plane of closure of the panel against the frame such that force applied to displace the panel in an opening direction of the panel is opposed by compressive forces applied by said pressure surface to said locking element.

10. A door or a window comprising:

a frame element;

a panel configured to abut against a portion of said frame element; and the latch arrangement of claim 1, deployed to selectively lock the panel to the frame element.

11. The door or the window of claim 10 wherein said panel is a sliding panel configured to slide towards and away from said frame element, between a closed state and an open state.

12. The door or the window of claim 10 wherein said panel is a hinged panel configured to rotate towards and away from said frame element, between a closed state and an open state.

* * * * *